US011615951B2

(12) United States Patent
Oro et al.

(10) Patent No.: US 11,615,951 B2
(45) Date of Patent: Mar. 28, 2023

(54) PULSATILE FLOW ATMOSPHERIC REAL TIME IONIZATION

(71) Applicant: IonSense, Inc., Saugus, MA (US)

(72) Inventors: Scott Oro, Ipswich, MA (US); Brian Musselman, Melrose, MA (US)

(73) Assignee: IonSense, Inc., Saugus, MA (US)

( * ) Notice: Subject to any disclaimer, the term of this patent is extended or adjusted under 35 U.S.C. 154(b) by 0 days.

(21) Appl. No.: 17/708,736

(22) Filed: Mar. 30, 2022

(65) Prior Publication Data

US 2022/0262614 A1 Aug. 18, 2022

Related U.S. Application Data

(63) Continuation of application No. 17/266,246, filed as application No. PCT/US2020/057321 on Oct. 26, 2020, now Pat. No. 11,424,116.

(60) Provisional application No. 62/967,558, filed on Jan. 29, 2020, provisional application No. 62/927,056, filed on Oct. 28, 2019.

(51) Int. Cl.

| | |
|---|---|
| ***H01J 49/16*** | (2006.01) |
| ***H01J 49/14*** | (2006.01) |
| ***H01J 49/42*** | (2006.01) |

(52) U.S. Cl.
CPC ..... *H01J 49/168* (2013.01); *H01J 49/14* (2013.01); *H01J 49/4265* (2013.01)

(58) Field of Classification Search
CPC ..... H01J 49/04; H01J 49/0422; H01J 49/14; H01J 49/168; H01J 49/426; H01J 49/4265
See application file for complete search history.

(56) References Cited

U.S. PATENT DOCUMENTS

2013/0260478 A1* 10/2013 Ewing ..... G01N 33/0057 436/501
2017/0084438 A1* 3/2017 Cooks ..... G01N 27/62

* cited by examiner

*Primary Examiner* — David E Smith
(74) *Attorney, Agent, or Firm* — D. Benjamin Borson; Borson Law Group PC

(57) ABSTRACT

This disclosure presents inventions for ionization, for example, for use in mass spectrometer devices and methods. In an embodiment, a device is provided for introduction of pulses of a first carrier gas into an ionization chamber and introduction of a second carrier gas into the ionization chamber. Electrodes in the chamber ionize the carrier gas and direct the ionized gas toward a sample for analysis. The second carrier gas can either assist in washing out the first carrier gas or may become ionized along with the first carrier gas to improve ionization of an analyte. In an embodiment, a method for producing ionized carrier gasses is provided.

4 Claims, 35 Drawing Sheets

Relative Intensity (%)
100
0

100
0

100
0

100
0

150
350
m/z

Relative Intensity (%)
100
0
0.1
0.7
time (minutes)

PULSATILE FLOW ATMOSPHERIC REAL TIME IONIZATION

FIELD OF THE INVENTION

The present invention relates to methods and devices for chemical analysis of molecules being ionized in ambient atmosphere through pulsed introduction of a carrier gas.

BACKGROUND OF THE INVENTION

Analysis of molecules of interest at ambient atmosphere in a laboratory or field setting can be accomplished using an ionizing species to convert the molecules of interest to ions and directing or evacuating the ions into a spectrometer. However, the ambient atmosphere in a laboratory or field setting can contain many 'background chemicals' that can also be detected. These background chemicals can vary based on the local environment. For example, trace chemicals present in the atmosphere of a laboratory might contain solvents, dust particles, aerosols, counter-ions, and chemicals being used for synthesis or extractions. Further, the background can include chemicals from human, animal, bacterial, viral or fungi activity including from the presence of the spectrometer operator/scientist including breath, perfume, fragrances, mouthwash, cosmetics, perspiration, flatulence, bacterial gasses, and bacterial odors. The presence of any one or more of these can lead to the generation of a persistent background. When the background becomes too abundant the process of ambient ionization and ion detection of molecules of interest can become inefficient in that the molecules of interest cannot be detected or are detected at such low abundance that they are obscured from detection by the detection of the background chemicals.

Trace chemicals present in the sample of interest can also be considered as background chemicals since they are present in the ionizing region but are not of interest. These include chemicals originating from the sample container, solvent residues, chemicals that are normally present but not important to characterization of the sample, and chemicals that might be introduced into the air surrounding the ionizing species including those from human activity such as solvents, or from other nearby analytical endeavors. For example, in a sample of urine the metabolite creatinine, a chemical waste product produced by muscle metabolism, is easily ionized and detected using a spectrometer. The kidneys filter creatinine and other waste products including urea out of circulating blood allowing them to be removed from the body through urination. Thus both of these compounds (creatinine and urea) are present as background chemicals during analysis of fluids from human origin. Further, urea itself is difficult to extract from urine which is why the analysis of drugs of abuse in workplace drug testing from urine is normally undertaken using chromatographic material to separate urea from the molecules of interest. The chromatographic material delays passage of the larger drug molecules while allowing the urea to be directed to waste. In the absence of the urea the larger drug molecules are ionized in the ambient atmosphere and after entering the spectrometer are easily detected.

Solvent effects can also contribute to background chemicals e.g. solvents used to dissolve samples such as dimethyl sulfoxide (DMSO), and chemicals added to samples to facilitate pH change or buffering that ionize might also contribute to the background.

In theory and practice eliminating background chemicals prior to the ambient ionization reduces the background chemical ions, i.e., the chemical noise, permitting increased sensitivity to the molecules of interest.

SUMMARY OF THE INVENTION

In an embodiment of the present invention in an ambient ionization experiment, pulsing the carrier gas used to generate the ionizing species can be used to increase the ionization of the molecule of interest and thereby allow a reduced detection limit. In an embodiment of the present invention with an ambient ionization experiment, jumping from one position and pulsing the carrier gas used to generate the ionizing species can be used to increase the ionization of the molecule of interest and thereby allow a reduced detection limit.

BRIEF DESCRIPTION OF THE DRAWINGS

All Direct Analysis Real Time (DART) Atmospheric Pressure Ionization (API) measurements were carried out at 300° C. unless otherwise specified. All samples were spotted using a TTP Labtech Mosquito, a positive displacement pipettor. All mass spectrometry was carried out on a THERMO SCIENTIFIC™ Q-EXACTIVE™ mass spectrometer. Various embodiments of the present invention will be described in detail based on the following Figures, where.

DETAILED DESCRIPTION OF THE INVENTION

Figure 1:
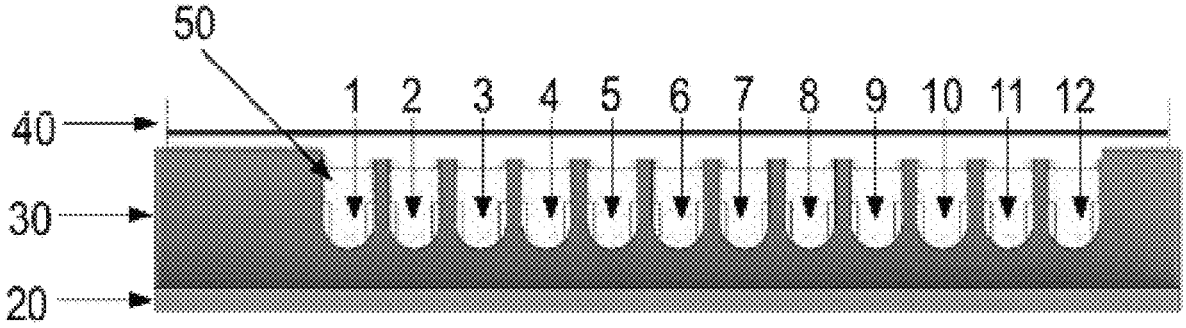
FIG. 1 is a paper consumable holding a wire mesh residing in a blank that inserts into a X-Y drive designed to enable presentation of a series of samples deposited on the mesh surface in regular intervals (1-12) into the ionizing species emitted from the distal end of a DART API source, according to various embodiments of the invention.

Abbreviations include:

API=Atmospheric Pressure Ionization; CIE=Continuous Ionization Experiment; DART=Direct Analysis Real Time; DESI=Desorption ElectroSpray Ionization; DMS=differential mobility spectrometer; ESI=electrospray ionization; GIS=gas ion separator; HE=Hybrid Experiment; RS=reactive species; PE=Pulsed Experiment; SIM=Single Ion Monitoring; TIC=Total Ion Current.

Definitions of certain terms that are used hereinafter include:

The transitional term "comprising" is synonymous with "including," "containing," or "characterized by," is inclusive or open-ended and does not exclude additional, unrecited elements or method steps.

The transitional phrase "consisting of" excludes any element, step, or ingredient not specified in the claim, but does not exclude additional components or steps that are unrelated to the invention such as impurities ordinarily associated with a composition.

The transitional phrase "consisting essentially of" limits the scope of a claim to the specified materials or steps and those that do not materially affect the basic and novel characteristic(s) of the claimed invention.

The term Gas-Ion Separator (GIS) will be used to refer to a device which separates ions from one or both neutral molecules and neutral atoms allowing the pre-concentration and transfer of the ions to an analysis system. The term 'inlet tube' will be used to refer to the low vacuum side of a GIS. The term 'outlet tube' will be used to refer to the high vacuum side of the GIS. In various embodiments of the invention, the contained tube can be an inlet tube. Active ionization refers to the process where an atmospheric analyzer not utilizing a radioactive nucleus can be used to ionize analyte ions. A capacitive surface is a surface capable of being charged with a potential. A surface is capable of being charged with a potential, if a potential applied to the surface remains for the typical duration time of an experiment, where the potential at the surface is greater than 50% of the potential applied to the surface. A vacuum of atmospheric pressure is approximately 760 torr. Here, 'approximately' encompasses a range of pressures from below $10^1$ atmosphere=$7.6\times10^3$ torr to $10^{-1}$ atmosphere=$7.6\times10^1$ torr. A vacuum of below $10^{-3}$ torr would constitute a high vacuum. Here, 'approximately' encompasses a range of pressures from below $5\times10^{-3}$ torr to $5\times10^{-6}$ torr. A vacuum of below $10^{-6}$ torr would constitute a very high vacuum. Here, 'approximately' encompasses a range of pressures from below $5\times10^{-6}$ torr to $5\times10^{-9}$ torr. In the following, the phrase 'high vacuum' encompasses high vacuum and very high vacuum.

The word 'contact' is used to refer to any process by which molecules of a sample in one or more of the gas, liquid and solid phases becomes adsorbed, absorbed or chemically bound to a surface.

A grid becomes 'coated' with a substrate when a process results in substrate molecules becoming adsorbed, absorbed or chemically bound to a surface. A grid can be coated when beads are adsorbed, absorbed or chemically bound to the grid. A grid can be coated when nano-beads are adsorbed, absorbed or chemically bound to the grid.

A filament means one or more of a loop of wire, a segment of wire, a metal ribbon, a metal strand or an un-insulated wire, animal string, paper, perforated paper, fiber, cloth, silica, fused silica, plastic, plastic foam, polymer, Teflon, polymer impregnated Teflon, cellulose and hydrophobic support material coated and impregnated filaments. In various embodiments of the invention, a filament has a diameter of approximately 50 microns to approximately 2 mm. In measuring the diameter of a filament, approximately indicates plus or minus twenty (20) percent. In an embodiment of the invention, the length of the filament is approximately 1 mm to approximately 25 mm. In measuring the length of a filament, approximately indicates plus or minus twenty (20) percent.

The term 'orientation' means the position of a mesh with respect to another section of mesh or with respect to a grid or a sample holder. In an embodiment of the invention, the mesh, the grid, or the sample holder can be mounted on an X-Y translation stage to enable precise orientation of the samples spotted on the mesh relative to the ionizing species. The controlling electronics and the stepper motor drivers, for the X-Y stages, can be mounted directly onto a box housing the X-Y translation stage, while the microcontroller that controls the orientation can be separately mounted.

The term 'proximity' means the position of a mesh or an area on the mesh with respect to another mesh or other area on the mesh.

The term 'registration' means when an area of a mesh (e.g., the proximal area) lines up with the mesh to deliver the heat from the mesh to the proximal area of the tine.

The term 'contacting' means the coming together or touching of objects or surfaces such as the sampling of a surface with an area of a mesh.

The shape of a mesh can be a cylinder, an elliptical cylinder, a long square block, a long rectangular block or a long thin surface.

The term 'hole' refers to a hollow space in an otherwise solid object, with an opening allowing light and/or particles to pass through the otherwise solid object. A hole can be circular, ellipsoid, pear shaped, a slit, or polygonal (including triangular, square, rectangular, pentagonal, hexagonal, heptagonal, and the like).

The term 'hot' in the context of hot atoms and/or hot molecules and the like, means a species having a velocity corresponding to a temperature above ambient (273 K) temperature. In an embodiment of the invention, a hot species has a velocity corresponding to a temperature of 300 K, 400 K, and 500 K.

The term 'Continuous flow' carrier gas means that the flow of the carrier gas into the discharge chamber is regulated in a constant fashion. The term 'Hybrid flow' carrier gas means that the flow of the carrier gas into the discharge chamber is pulsed on when the linear rail is moving the mesh for a measured time interval and otherwise there is no flow of the carrier gas into the discharge chamber. The term 'Pulsed flow' carrier gas means that the flow of the carrier gas into the discharge chamber is pulsed on when the linear rail is stopped for a time period and otherwise there is no flow of the carrier gas into the discharge chamber.

The term 'corona discharge' means a discharge that occurs at relatively high gas pressures (e.g. at atmospheric pressure) in an electric field which is strongly non-uniform (for example by placing a thin wire inside a metal cylinder having a radius much larger than the wire). The electric field is sufficiently high to cause the ionization of the gas surrounding the wire, but not high enough to cause electrical breakdown or arcing to nearby conductor. The term 'arc discharge' means a discharge that relies on thermionic emission of electrons from the electrodes supporting the arc and that is characterized by a lower voltage than a glow discharge, but has a strong current. The term 'glow discharge' means a discharge that is produced by secondary electron emission.

The term 'first atmospheric pressure chamber' means a chamber at approximately atmospheric pressure.

The term 'discharge' means one or more of a corona discharge, an arc discharge and a glow discharge.

A metal comprises one or more elements consisting of lithium, beryllium, boron, carbon, nitrogen, oxygen, sodium, magnesium, aluminum, silicon, phosphorous, sulfur, potassium, calcium, scandium, titanium, vanadium, chromium, manganese, iron, cobalt, nickel, copper, zinc, gallium, germanium, arsenic, selenium, rubidium, strontium, yttrium, zirconium, niobium, molybdenum, technetium, ruthenium, rhodium, palladium, silver, cadmium, indium, tin, antimony, tellurium, cesium, barium, lanthanum, cerium, praseodymium, neodymium, promethium, samarium, europium, gadolinium, terbium, dysprosium, holmium, erbium, thulium, ytterbium, lutetium, hafnium, tantalum, tungsten, rhenium, osmium, iridium, platinum, gold, mercury, thallium, lead, bismuth, polonium, francium and radium. Thus a metal includes for example, a nickel titanium alloy known as nitinol or a chromium iron alloy used to make stainless steel.

A plastic comprises one or more of polystyrene, high impact polystyrene, polypropylene, polycarbonate, low density polyethylene, high density polyethylene, polypropylene, acrylonitrile butadiene styrene, polyphenyl ether alloyed with high impact polystyrene, expanded polystyrene, polyphenylene ether and polystyrene impregnated with pentane, a blend of polyphenylene ether and polystyrene impregnated with pentane or polyethylene and polypropylene.

A polymer comprises a material synthesized from one or more reagents selected from the group comprising of styrene, propylene, carbonate, ethylene, acrylonitrile, butadiene, vinyl chloride, vinyl fluoride, ethylene terephthalate, terephthalate, dimethyl terephthalate, bis-beta-terephthalate, naphthalene dicarboxylic acid, 4-hydroxybenzoic acid, 6-hyderoxynaphthalene-2-carboxylic acid, mono ethylene glycol (1,2 ethanediol), cyclohexylene-dimethanol, 1,4-butanediol, 1,3-butanediol, polyester, cyclohexane dimethanol, terephthalic acid, isophthalic acid, methylamine, ethylamine, ethanolamine, dimethylamine, hexamthylamine diamine (hexane-1,6-diamine), pentamethylene diamine, methylethanolamine, trimethylamine, aziridine, piperidine, N-methylpiperideine, anhydrous formaldehyde, phenol, bisphenol A, cyclohexanone, trioxane, dioxolane, ethylene oxide, adipoyl chloride, adipic, adipic acid (hexanedioic acid), sebacic acid, glycolic acid, lactide, caprolactone, aminocaproic acid and or a blend of two or more materials synthesized from the polymerization of these reagents.

A plastic foam is a polymer or plastic in which a gaseous bubble is trapped including polyurethane, expanded polystyrene, phenolic foam, XPS foam and quantum foam.

A 'mesh' means one or more of two or more connected filaments, two or more connected strings, foam, perforated paper, screens, paper screens, plastic screens, fiber screens, cloth screens, polymer screens, silica screens, TEFLON® (polytetrafluoroethylene (PVDF)) screens, polymer impregnated Teflon screens, and cellulose screens. In various embodiments of the invention, a mesh includes one or more of three or more connected filaments, three or more connected strings, mesh, foam, a grid, perforated paper, screens, plastic screens, fiber screens, cloth, and polymer screens. In an embodiment of the invention, a mesh can have approximately 10 filaments per mm. In another embodiment of the invention, a mesh can have approximately 20 filaments per mm. In an additional embodiment of the invention, a mesh can have approximately 30 filaments per mm. In an alternative embodiment of the invention, a mesh can have approximately 100 filaments per mm. In designing the number of filaments per mm, approximately indicates plus or minus twenty (20) percent.

A 'substratum' is a polymer, a metal, and or a plastic.

A 'pulse generator' is a device such as a valve, a pressure regulator or a voltage controlled pulse generator which can be adapted to generate short (approximately 0.1 second, where approximately means plus or minus ten (10) percent) pulses of a carrier gas.

A 'carrier gas' is gas capable of generating an excited species in the presence of a discharge at atmospheric pressure.

A 'grid' is a substratum in which either gaps, spaces or holes have been punched or otherwise introduced into the substratum or in which a window or section has been cut out or otherwise removed from the substratum and a mesh has been inserted into the removed window or section. In an embodiment of the invention, the grid can have a thickness between a lower limit of approximately 1 micron and an upper limit of approximately 1 cm. In this range, approximately means plus or minus twenty (20) percent.

The phrase 'background chemical' means a 'matrix molecule' and/or an 'introduced contaminant'.

The phrase a 'molecule of interest' or 'analyte' means any naturally occurring species (e.g., caffeine, cocaine, tetra hydro cannabinol), or synthetic molecules that have been introduced to the biological system e.g., pharmaceutical drugs (e.g., lidocaine, methadone, sildenafil, Lipitor, enalapril and derivatives thereof), and recreational drugs (e.g., morphine, heroin, methamphetamine, and the like and derivatives thereof).

The phase 'introduced contaminant' means a chemical that becomes associated with a sample during sample preparation and/or sample analysis. An introduced contaminant can be airborne or present in or on surfaces that the sample is in contact. For example, perfumes and deodorants can be associated with and analyzed during sample analysis. Alternatively, phthalates present in plastic tubes used to handle samples can leach out of the plastic tube into the sample and thereby be introduced into the sample.

The phrase 'background chemical' means a 'matrix molecule' and/or an 'introduced contaminant'.

The phrase an 'ion suppressor molecule' means a background chemical which suppresses ionization of a molecule of interest and/or generates a background species which ionizes to the detriment of detection of a molecule of interest.

The phrase 'background ion' or 'background species' refers to an ion formed from a background chemical. The background species can include the molecule itself, an adduct of the molecule, a fragment of the molecule or combinations thereof.

The phrase 'matrix effect' refers to the reduction in ionization of a molecule of interest due to the presence of a background species. A matrix effect is caused when a background chemical suppresses ionization of a molecule of interest and/or a background species ionizes to the detriment of a molecule of interest. Without wishing to be bound by theory, in the former case it is believed that the molecule of interest is not ionized by the presence of the background chemical. In the latter case, the resulting mass spectrum is dominated by a background species to the detriment of the analysis of the molecule of interest. The background species can be suppressing and/or masking the ionization of a molecule of interest.

The phrase 'analysis volume' refers to the aliquot of sample that is analyzed, for example applied to a mesh for analysis.

The phrase an 'ion intensifier' means a chemical that inhibits the matrix effect.

The term 'peak abundance' is the number of ions produced. The peak abundance of the protonated molecule ion of a sample is a measure of the number of intact ions of the sample produced (other processes such as cationization can also be a measure of the number of intact ions of the sample produced). The relative peak abundance of two species is the sum of the intensity corresponding to each species.

DART API CIE

DART API CIE is a method of analysis that was introduced with, for example, QuickStrip and involves presenting a series of samples deposited in individual discrete positions on a movable surface. The surface is mounted on a holder fixed to a linear rail, where the linear rail allows a constant linear motion (i.e., a fixed velocity) to present the samples as a series for analysis. The surface (typically a mesh) contains areas where sample is present and areas where the sample is not present. The linear motion thereby results in the presentation of the samples in front of a static source of ionizing species and thereby permits the scanning (and analysis) of the samples.

Figure 3:
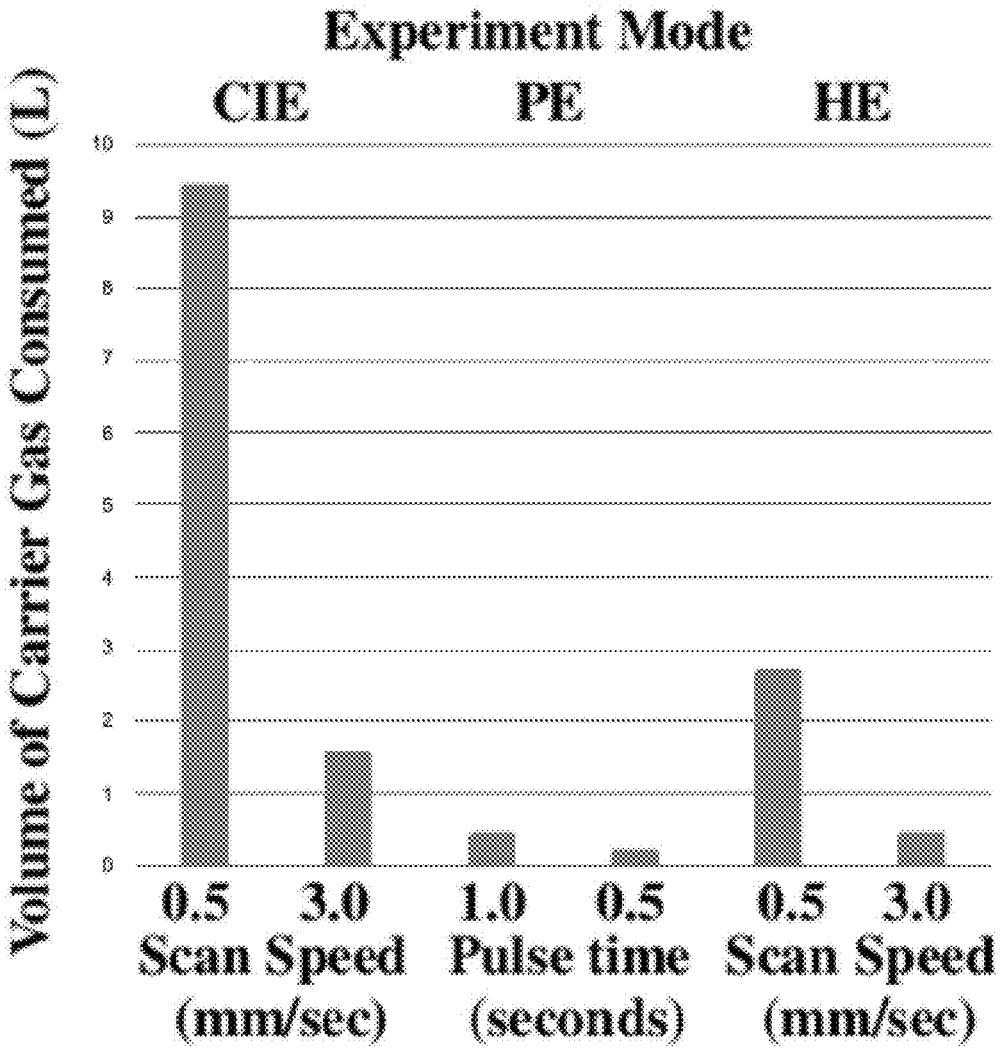
FIG. 3 is a plot of the relative helium consumption with three (3) different experiments to present the sample: continuously at a speed of 3 mm/second which shall be referred to hereinafter as 'Continuous Ionization Experiment (CIE)'; in a hybrid mode which involved presenting the samples discontinuously with the carrier gas turned off prior to presentation of the sample and then the carrier gas is turned on for three (3) seconds when the sample is presented and moving at 3 mm/second and then discontinued until the next sample was presented for analysis, which shall be referred to hereinafter as 'Hybrid Experiment (HE)'; and in a pulsed mode which involved presenting the samples discontinuously with the carrier gas turned off prior to presentation of the sample and then the carrier gas turned on for one (1) second while the sample is statically presented (i.e. not moved) and then the carrier gas turned off prior to presentation of the next sample for analysis, which shall be referred to hereafter as 'Pulsed Experiment (PE)'.

DART API CIE utilizes a carrier gas that generates the ionizing species which is directed at a surface (e.g., a 1536 QuickStrip mesh card). In the DART API CIE mode of operation, the carrier gas is not pulsed and therefore ionizing species are directed at the surface irrespective of whether a sample is presented to the ionizing species or not. Therefore, valuable purified carrier gasses are being wasted (see FIG. 3).

Further, in DART API CIE mode, background species are being produced when no sample is presented on the surface. Without wishing to be bound by theory, it is believed that as the ionizing species interact with leading (or trailing edge) of the sample, analytes in the sample compete with background chemicals for the charge generated by the ionizing species. If the analyte wins this competition event, analyte ions are formed. If the background chemicals win the competition, background species are formed. Without wishing to be bound by theory, it is believed that the competition is not exclusively won by any one species and is driven by the proton affinity in the positive ionization mode. Without wishing to be bound by theory, it is further believed that the formation of large quantities of the background species before the leading edge can detract from the detection of analyte species being formed at the leading edge.

The advantage with the DART API CIE method is that it allows for inaccurate (or irreproducible) deposition of the sample for analysis. As long as the sample is somewhere present in the region being showered by the ionizing gas. In the DART API CIE method the continuous shower of ionizing species results in production of ions from both sample and background during the experiment.

DART API PE

DART API PE is a method of analysis that seeks to minimize the wasted use of carrier gas by taking advantage of accurate deposition of samples using robotics and similar accurate presentation of a sample in front of a source providing a shower of ionizing species. By turning off the carrier gas entering the source, while the sample is moved into position, the ionizing species formed by the source is conserved. Without wishing to be bound by theory, it is believed that when the carrier gas is turned off, the discharge continues, but without the flow of carrier gas the ionizing species exiting the source are attenuated. Depending on the spacing of sample and time required for desorption of the sample, a dramatic reduction in the consumption of carrier gas can be observed (see FIG. 3). That is, with accurate deposition of sample and accurate timing, it is not necessary to address inaccurate (or irreproducible) deposition of the sample. Accordingly, with accurate deposition and accurate location of the ionizing species, it is unnecessary to have a broad beam of ionizing species. Instead, a narrow end cap can be utilized to produce a defined shower of ionizing species with a narrower spray pattern (i.e., having a smaller range of impact).

Without wishing to be bound by theory, it is believed that by presenting a static sample, background species are only observed if they compete successfully for the charge with analytes present in the sample. As the ionizing species interact with the sample changes in analyte ion intensity can be attributed to depletion of background species or analyte species. In an embodiment of the invention, using the DART API PE mode of operation with a time duration pulse, the ionization of the analyte was optimized, where the time duration was 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, or 2.0 seconds. In an embodiment of the invention, using the DART API PE mode of operation with a one (1) second pulse, the ionization of the analyte was optimized. In an embodiment of the invention, using the DART API PE mode of operation with a two (2) second pulse, the ionization of the analyte was optimized.

DART API HE

DART API HE is a method of analysis that seeks to minimize the wasted use of carrier gas while retaining the features of the DART API CIE. That is, by turning off the carrier gas while positioning the ionizing species in the region of the sample, an equally dramatic reduction in the consumption of carrier gas is observed (see hybrid 3 mm/sec FIG. 3).

Carrier Gas

DART API in the presence of a carrier gas generates a plasma around the discharge. Reducing the carrier gas pressure from approximately 70 psi to approximately 0 psi for between approximately one (1) second and approximately three (3) seconds does not detrimentally affect the stability of the plasma. In this pressure range, approximately means plus or minus twenty (20) percent. In this time range, approximately means plus or minus twenty (20) percent. Without wishing to be bound by theory, it is believed that the plasma surrounding the electrodes is retained in a region proximal to the stable plasma. Without the carrier gas being fed into the plasma the ionizing species do not flow out of the plasma towards the sample. A pulse of carrier gas is generated by increasing the pressure applied to the carrier gas in the region proximal to the stable plasma which forces the ionizing species to flow out of the stable plasma production region towards the sample.

Helium DART

DART is another API method suitable for the analysis of analytes. Various embodiments of DART API are described in U.S. Pat. No. 7,112,785 to Laramee (hereinafter referred to as the '785 patent) which is herein expressly incorporated by reference in its entirety and for all purposes. The '785 patent is directed to desorption ionization of molecules from surfaces, liquids and vapor using a carrier gas containing reactive species (RS). The DART API can use a large volume of carrier gas, e.g., helium is suitable although other inert gases that can generate RS can be used.

Nitrogen DART

An API can ionize analyte molecules without the use of solvents to dissolve the analyte. The ionization occurs directly from solids and liquids. Molecules present in the gas phase can also be ionized by the reactive species exiting the API. In an embodiment of the invention, the reactive species utilized can be excited nitrogen atoms or molecules. In an embodiment of the invention, the reactive species can produce long lived metastable species to impact the analyte molecules at atmospheric pressure and, e.g., to affect ionization, see also U.S. Utility patent application Ser. No. 16/422,339 entitled "APPARATUS AND METHOD FOR REDUCING MATRIX EFFECTS", inventor Brian D. Musselman, filed May 24, 2019, which is incorporated herein by reference in its entirety and for all purposes.

Gas-Ion Separator (GIS)

In various embodiments of the invention, devices and methods for transferring analyte ions desorbed from the sorbent surface using an atmospheric analyzer into the inlet of a mass spectrometer can utilize a GIS. Embodiments of this invention include devices and methods for collecting and transferring analyte ions and/or other analyte species formed within a carrier to the inlet of a mass spectrometer.

In an embodiment of the invention, one or both the inlet and the outlet GIS tubing can be made of one or more materials selected from the group consisting of stainless steel, non-magnetic stainless steel, steel, titanium, metal, flexible metal, ceramic, silica glass, plastic and flexible plastic. In an embodiment of the invention, the GIS tubing can range in length from 10 millimeters to 10 meters. In an embodiment of the invention, the GIS tubing can be made of non-woven materials. In an embodiment of the invention, the GIS tubing can be made from one or more woven materials.

In various embodiments of the invention, a GIS comprising two or more co-axial tubes with a gap between the tubes and a vacuum applied in the gap region is used to allow large volumes of carrier gas to be sampled. In various embodiments of the invention, a GIS is made up of an inlet tube and an outlet tube. In an embodiment of the invention, the proximal end of the inlet tube is closest to the sorbent surface and the distal end of the inlet tube can be some distance away from the proximal end where a vacuum can be applied. In various embodiments of the invention, the proximal end of the outlet tube is adjacent the distal end of the inlet tube and the distal end of the outlet tube enters the spectroscopy system.

Ninety Degree GIS

The use of robotic sample depositions, allows systems to deposit sub-microliter volumes of sample with precise high speed X-Y plate orientation for DART API analysis of the samples. Previously, the performance of a Ninety Degree GIS component has been compromised by high background and matrix effects. Unexpectedly, using the pulsed carrier gas source and stepping to a fixed position, the Ninety Degree GIS shows no signs of high background and matrix effects. Accordingly, the pulsed carrier gas source and stepping to a fixed position allows direct DART API with the Ninety Degree GIS analysis from higher performance robotics without the requirement for moving the sample from the sample deposition robot. Further, the Ninety Degree GIS can be combined with an extended X-Y plate with a holder that allows movement of the samples deposited onto the QuickStrip mesh through the desorption ionization region located at the distal end of the DART source such that the sample deposited onto the front side of the mesh can be vaporized and ionized in close proximity to the proximal end of the GIS positioned at the back side of the mesh. The Ninety Degree GIS can be combined with an extended X-Y plate with a holder that allows movement of the samples deposited onto the QuickStrip mesh through the desorption ionization region located at the distal end of the DART source such that the sample deposited onto the front side of the mesh can be vaporized and ionized in close proximity to the proximal end of the GIS positioned at the back side of the mesh.

Figure 15A:
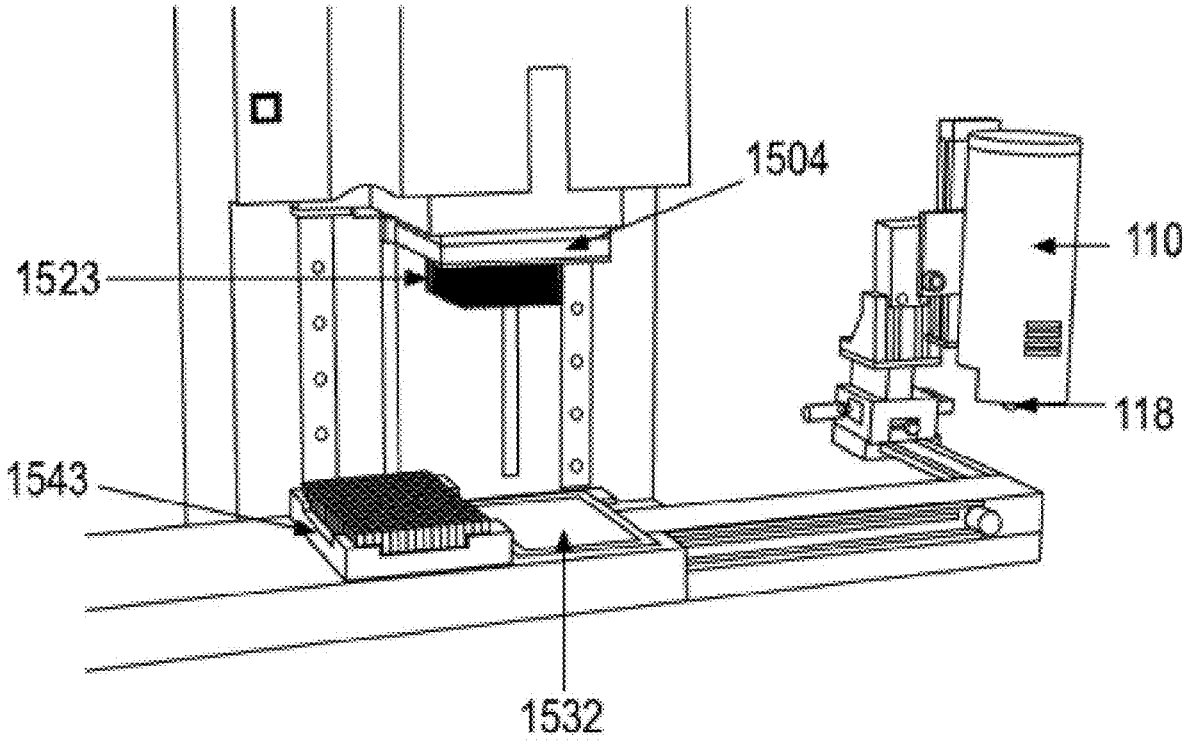
FIG. 15A is a line drawing of the pipetting robot (1504) for delivering low volume samples onto the surface of a QuickStrip-96 wire mesh, according to an embodiment of the invention.
Figure 15B:
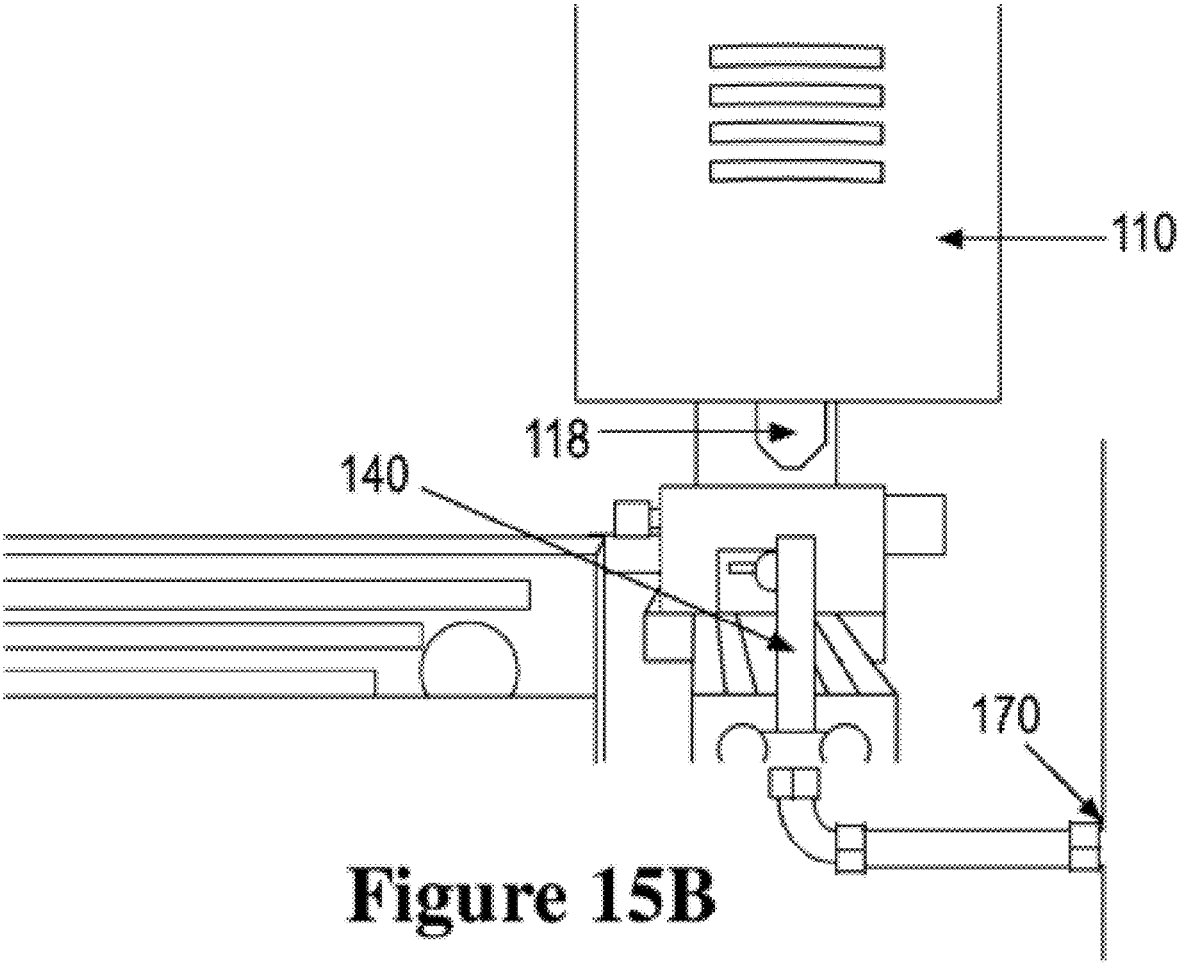
FIG. 15B is a line drawing of the DART API source mounted in the vertical position with the GIS interface connected at a Ninety degree angle to a mass detector, according to an embodiment of the invention.

FIGS. 15A and 15B depict line drawings of apparatus of this disclosure. FIG. 15A is a line drawing of the pipetting robot (1504) with a series of 16 positive displacement pipets (1523) for low volume samples onto the surface of a QuickStrip-96 wire mesh consumable (1532) mounted on its sampling stage (1543). FIG. 15A also shows the DART API source mounted in the vertical position (110) with a 2.5 mm exit cap (118) mounted in line with the Ninety Degree GIS with the MS instrument. Once the samples have been pipetted in their precise positions the sampling stage is moved to the robotic arm designed to move sample through the ionizing region of the DART API source to ionize the samples in the PE mode. FIG. 15B is a line drawing of the DART API source mounted in the vertical position (110) with a 2.5 mm exit cap (118) mounted in line with the Ninety Degree GIS (140) with the MS (170) instrument. Attempts to undertake the Ninety Degree GIS experiment with DART API CIE were sometimes not successful. Without wishing to be bound by theory, it is believed with DART API CIE may generate background species and that due to the Ninety Degree GIS configuration those background species are not removed from the ionizing region as quickly as in the linear configuration and therefore background species competition with analyte species is increased.

Utilizing the DART API PE with the Ninety Degree GIS configuration enabled the generation of analyte ions with greater efficiency than the DART API CIE where timing of the pulse of ionizing species to occur only when sample was present, reduced the production of background species. As a consequence of there being fewer background species, the potential for intermolecular interactions was reduced. As a result, with fewer intermolecular interactions the analyte species can transit the Ninety Degree GIS more efficiently.

Rapid and reproducible desorption and analysis of fentanyl was facilitated with the ninety degree GIS using DART API PE, where all of the analyte ion species present in the sample were detected. This was also the case for ultralow volume samples (200 nL) where the deposition of the samples and the location of the sample in front of the ionizing species were under the control of the accurate robotic system. Accordingly, DART API PE with the extended X-Y plate holder enables the combination of DART direct ionizing species at the front side of the plate. Without wishing to be bound by theory, it is believed that ions produced by using the pulsed carrier gases are less numerous in absolute number reducing the potential for intermolecular ion-ion interactions and therefore transit the elbow more efficiently.

Cap Dimensions

Depending on the distance between the source of the ionizing species and the mesh the spot size of the ionizing species impacted the mesh can vary. A cap with a cap hole through which the ionizing species emanates can be used to restrict the spot size at the sample. The dimensions of the cap and the cap hole can be chosen to adjust the spot size of the ionizing species at the sample. The cap (117, 118) can extend a distance (121) between a lower limit of approximately 0.1 mm and an upper limit of approximately 5.0 mm (e.g. 0.2, 0.3, 0.4, and the like up to 4.5, 4.6, 4.7, 4.8, 4.9 mm), where approximately in this range means plus or minus twenty (20) percent. In various embodiments of the invention, the distance (121) can be continuously adjustable to optimize scan speed depending on a number of factors including for example the number of samples to be analyzed. The cap hole (119) can have a variety of shapes, including ovoid, elliptical, rectangular, square and circular. A circular cap hole (119) can have a diameter between a lower limit of approximately 0.1 mm and an upper limit of approximately 5.0 mm (e.g. 0.2, 0.3, 0.4, and the like up to 4.5, 4.6, 4.7, 4.8, 4.9 mm), where approximately in this range means plus or minus twenty (20) percent. For non-circular shaped cap holes (119) the largest extent of the opening in the cap hole can be between a lower limit of approximately 0.1 mm and an upper limit of approximately 5.0 mm (e.g. 0.2, 0.3, 0.4, and the like up to 4.5, 4.6, 4.7, 4.8, 4.9 mm), where approximately in this range means spatial resolution of plus or minus twenty (20) percent. In various embodiments of the invention, the cap hole (119) can be continuously adjustable to optimize spot size and spatial resolution, thereby allowing selection of appropriate carrier gas pulsing and/or scan speeds to optimize sensitivity and minimize generation of background species, contamination or artifacts.

Figure 2A:
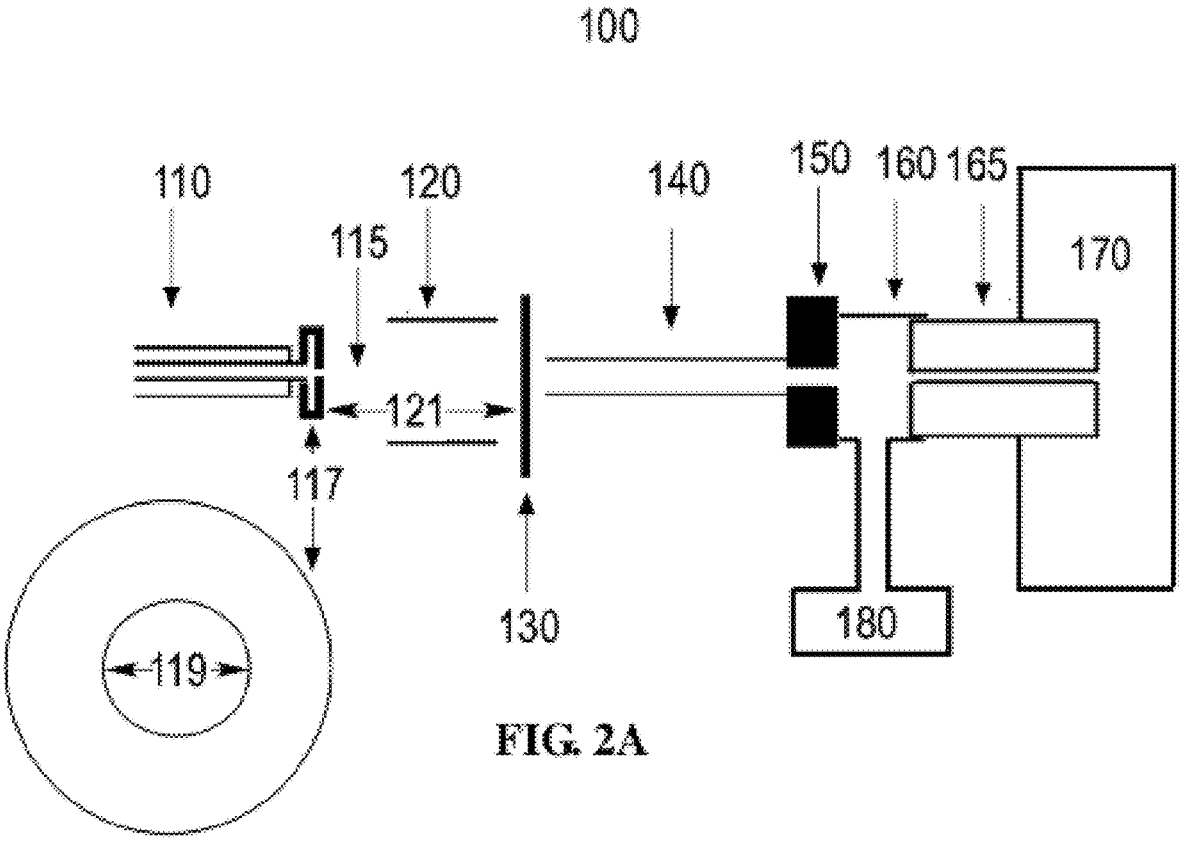
FIG. 2A is a schematic diagram of ionizing species from a DART API source passed through a narrow cap and directed to a sample applied to a mesh inserted into the ionizing volume of the spectrometer, according to various embodiments of the invention.

In an embodiment of the present invention, as shown in FIG. 2A for the narrow cap (117) with a 1.0 mm diameter hole (119), the distance (121) between the distal end of the DART source (115), to the sample (130) was approximately 2.0 mm. This configuration (narrow cap with 1.0 mm diameter hole and 2.0 mm distance to sample) will be referred to as a '1.0 mm exit cap'. With the 1.0 mm exit cap configuration, it was possible to analyze spots that were 2.25 mm apart (i.e., from an adjacent sample). Typically, the 200 nL samples analyzed dried as a spot of approximately 1.1 mm diameter, resulting in spots which were approximately 1.1 mm apart. In this configuration, using DART API CIE with 2.5 mm/sec scan speed, there was minimal contribution of species from the adjacent sample observed (i.e., minimal cross contamination). Accordingly, in an embodiment of the present invention, the spatial resolution at 2.5 mm/sec is approximately 1 mm. In this range, approximately means plus or minus twenty (20) percent.

Figure 2B:
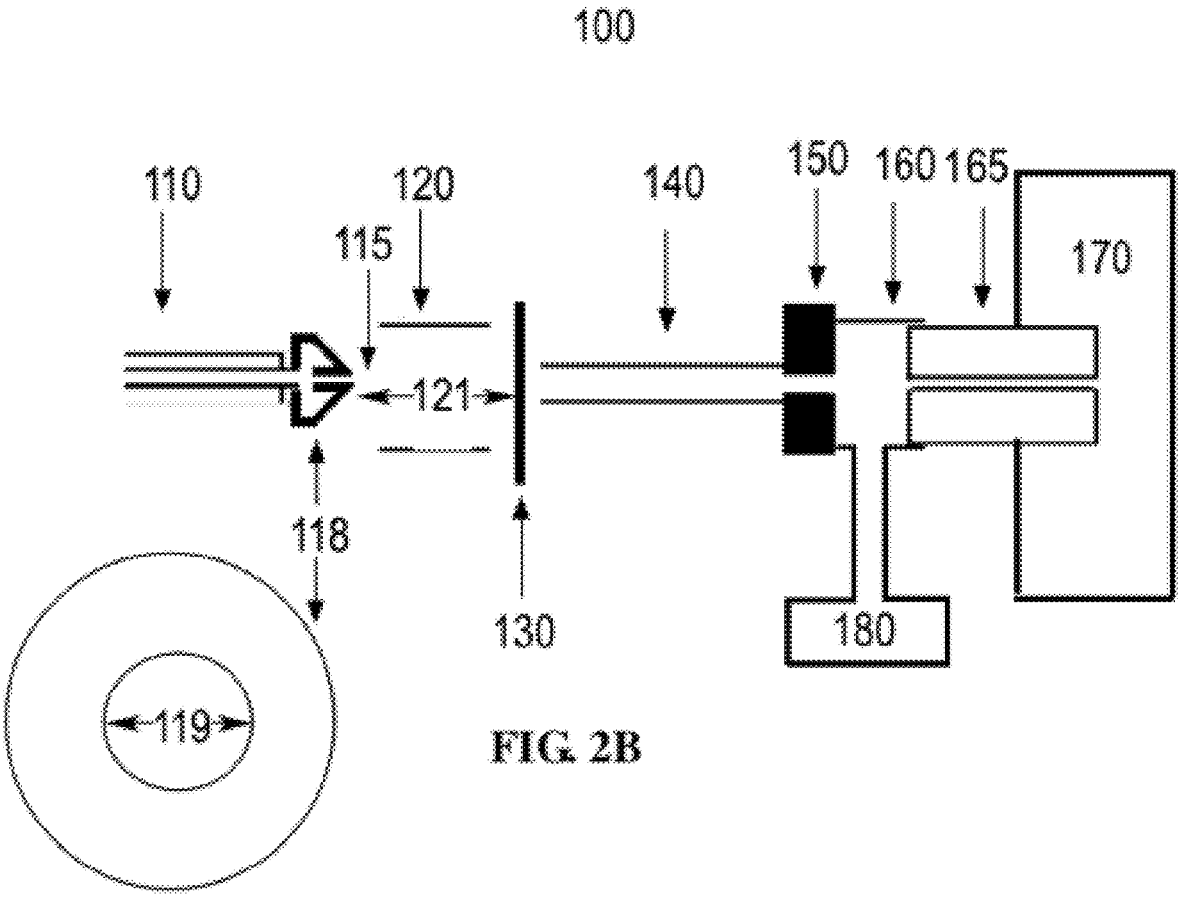
FIG. 2B is a schematic diagram of ionizing species from a DART API source passed through a longer cap and directed to a sample applied to a mesh inserted into the ionizing volume of the spectrometer, according to various embodiments of the invention.

In an alternative embodiment of the present invention, a longer cap (118) with an approximately 2.5 mm diameter hole (119) and a distance (121) between the distal end of the DART source (115), to the sample (130) of approximately 1.0 mm, is shown in FIG. 2B. This configuration (longer cap with 2.5 mm diameter hole and 1.0 mm distance to sample) will be referred to as a '2.5 mm exit cap'.

1536 Sample

In an embodiment of the present invention, as shown in FIGS. 13 and 14 using DART API PE with the 2.5 mm exit cap it was possible to analyze spots formed by applying 200 nL aliquots of xxx samples that were 2.25 mm apart (x direction) and 2.25 mm (y direction) (i.e., from an adjacent sample) without any observation of species from the adjacent sample (i.e., without any cross contamination). Accordingly, in an embodiment of the present invention, the spatial resolution is approximately 1 mm. In this range, approximately means plus or minus twenty (20) percent.

Figures 13A, 13B, 13C, 13D:
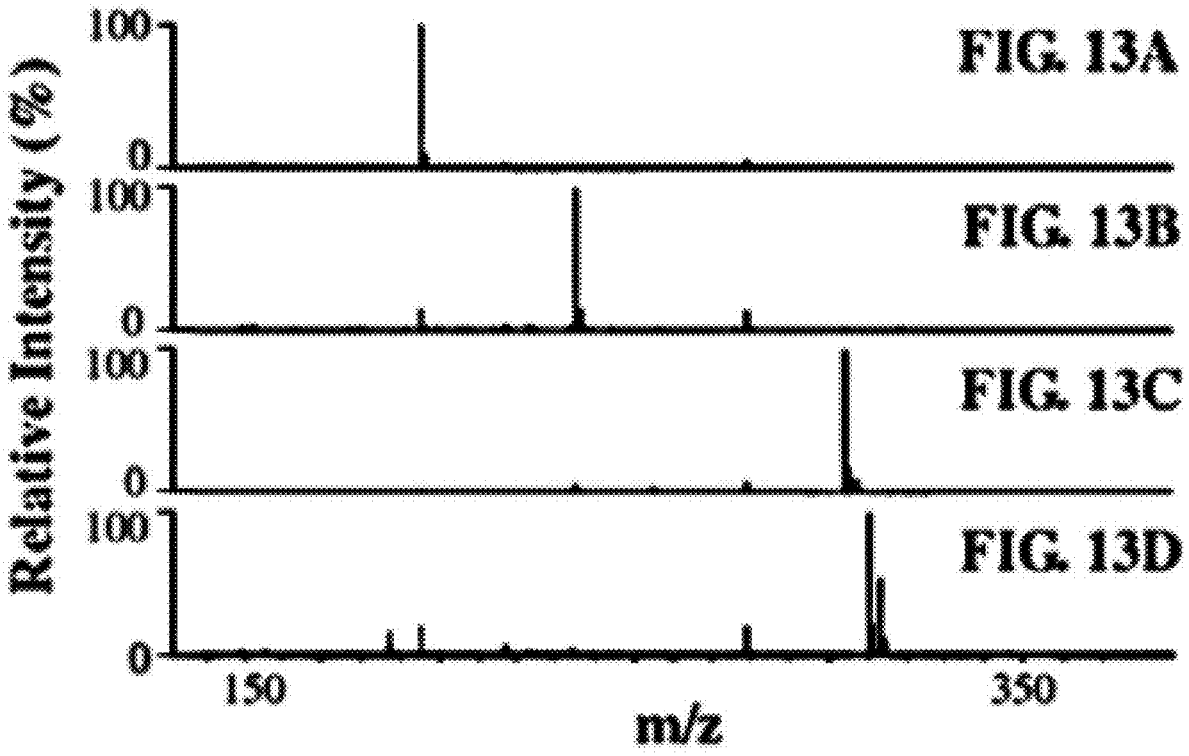
FIG. 13A is the DART API PE (with a 2.5 mm exit cap) mass spectrum for caffeine (SIM 195.1±0.5 Da) present in a 200 nL volume of a mixture of cocaine (1 mg/mL), lidocaine (1 mg/mL), and methadone (1 mg/mL), applied to a mesh sample presented in the 1536 sample plate format, according to an embodiment of the invention.
FIG. 13B is the DART API PE (with a 2.5 mm exit cap) mass spectrum for lidocaine (SIM 235.2±0.5 Da) present in a 200 nL volume of a mixture of caffeine (1 mg/mL), cocaine (1 mg/mL), and methadone (1 mg/mL), applied to a mesh sample presented in the 1536 sample plate format, according to an embodiment of the invention.
FIG. 13C is the DART API PE (with a 2.5 mm exit cap) mass spectrum for cocaine (SIM 304.3±0.5 Da) present in a 200 nL volume of a mixture of caffeine (1 mg/mL), lidocaine (1 mg/mL), and methadone (1 mg/mL), applied to a mesh sample presented in the 1536 sample plate format, according to an embodiment of the invention.
FIG. 13D is the DART API PE (with a 2.5 mm exit cap) mass spectrum for methadone (SIM 310.2±0.5 Da) present in a 200 nL volume of a mixture of caffeine (1 mg/mL), lidocaine (1 mg/mL), and cocaine (1 mg/mL), applied to a mesh sample presented in the 1536 sample plate format, according to an embodiment of the invention.

FIG. 13A is the DART API PE (with a 2.5 mm exit cap) mass spectrum for caffeine (SIM 195.1±0.5 Da) present in a 200 nL volume of a mixture of cocaine (1 mg/mL), lidocaine (1 mg/mL), and methadone (1 mg/mL), applied to a mesh sample presented in the 1536 sample plate format. FIG. 13B is the DART API PE (with a 2.5 mm exit cap) mass spectrum for lidocaine (SIM 235.2±0.5 Da) present in a 200 nL volume of a mixture of caffeine (1 mg/mL), cocaine (1 mg/mL), and methadone (1 mg/mL), applied to a mesh sample presented in the 1536 sample plate format. FIG. 13C is the DART API PE (with a 2.5 mm exit cap) mass spectrum for cocaine (SIM 304.3±0.5 Da) present in a 200 nL volume of a mixture of caffeine (1 mg/mL), lidocaine (1 mg/mL), and methadone (1 mg/mL), applied to a mesh sample presented in the 1536 sample plate format. FIG. 13D is the DART API PE (with a 2.5 mm exit cap) mass spectrum for methadone (SIM 310.2±0.5 Da) present in a 200 nL volume of a mixture of caffeine (1 mg/mL), lidocaine (1 mg/mL), and cocaine (1 mg/mL), applied to a mesh sample presented in the 1536 sample plate format.

Figures 14A, 14B, 14C, 14D, 14E:
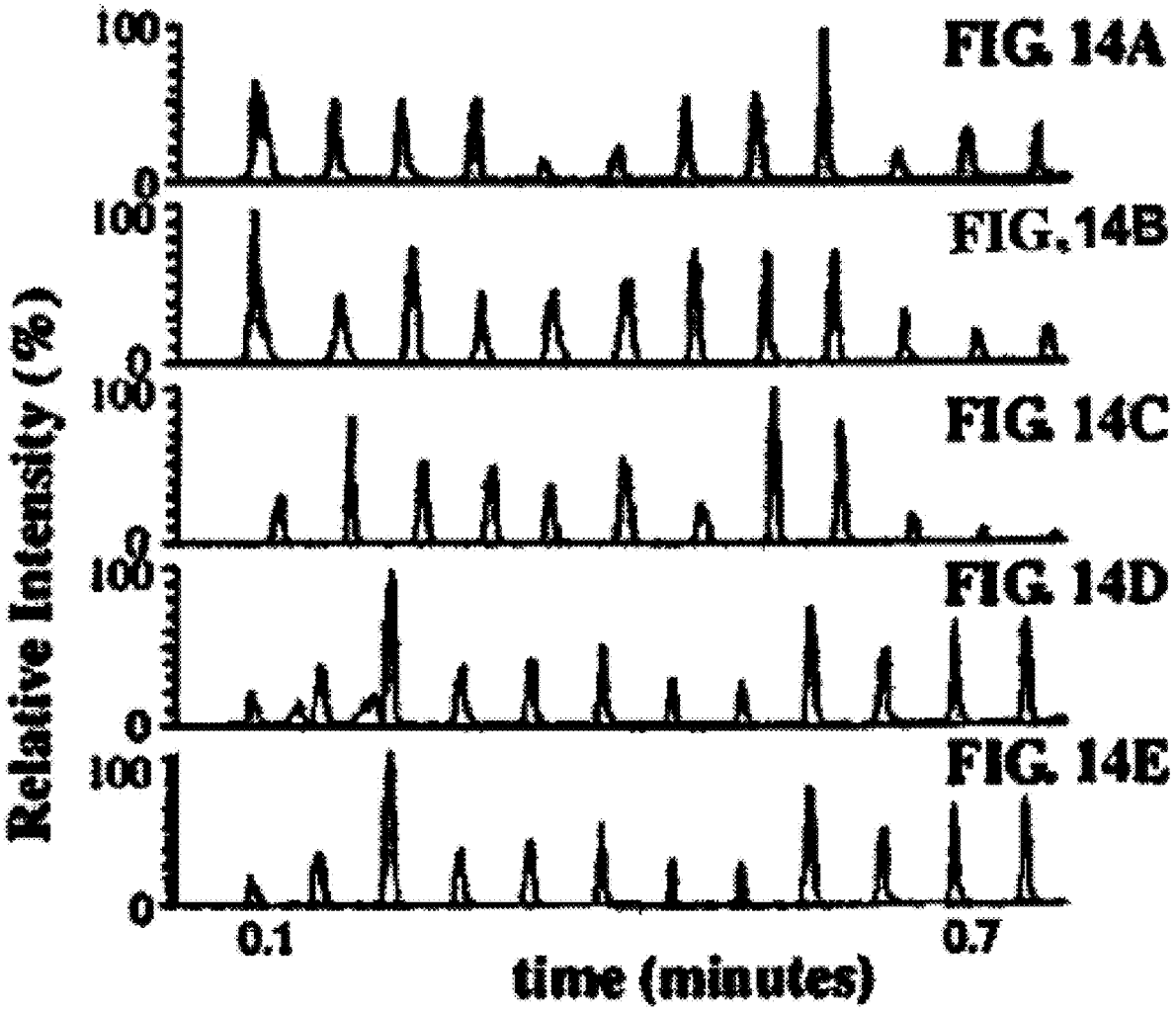
FIG. 14A is the DART API PE (with a 2.5 mm exit cap) mass chromatogram for caffeine (SIM 195.1±0.5 Da) present in a 200 nL volume of a mixture of cocaine (1 mg/mL), lidocaine (1 mg/mL), and methadone (1 mg/mL), applied to a mesh (twelve (12) replicates, in positions 1-12) sample presented in the 1536 sample plate format, according to an embodiment of the invention.
FIG. 14B is the DART API PE (with a 2.5 mm exit cap) mass chromatogram for lidocaine (SIM 235.2±0.5 Da) present in a 200 nL volume of a mixture of caffeine (1 mg/mL), cocaine (1 mg/mL), and methadone (1 mg/mL), applied to a mesh (twelve (12) replicates, in positions 1-12) sample presented in the 1536 sample plate format, according to an embodiment of the invention.
FIG. 14C is the DART API PE (with a 2.5 mm exit cap) mass chromatogram for cocaine (SIM 304.3±0.5 Da) present in a 200 nL volume of a mixture of caffeine (1 mg/mL), lidocaine (1 mg/mL), and methadone (1 mg/mL), applied to a mesh (twelve (12) replicates, in positions 1-12) sample presented in the 1536 sample plate format, according to an embodiment of the invention.
FIG. 14D is the DART API PE (with a 2.5 mm exit cap) mass chromatogram for methadone (SIM 310.2±0.5 Da) present in a 200 nL volume of a mixture of caffeine (1 mg/mL), lidocaine (1 mg/mL), and cocaine (1 mg/mL), applied to a mesh (twelve (12) replicates, in positions 1-12) sample presented in the 1536 sample plate format, according to an embodiment of the invention.
FIG. 14E is the DART API PE (with a 2.5 mm exit cap) TIC for methadone (1 mg/mL), caffeine (1 mg/mL), lidocaine (1 mg/mL), and cocaine (1 mg/mL) samples applied to a mesh (twelve (12) replicates, in positions 1-12) sample presented in the 1536 sample plate format, according to an embodiment of the invention.

FIG. 14A is the DART API PE (with a 2.5 mm exit cap) mass chromatogram for caffeine (SIM 195.1±0.5 Da) present in a 200 nL volume of a mixture of cocaine (1 mg/mL), lidocaine (1 mg/mL), and methadone (1 mg/mL), applied to a mesh (twelve (12) replicates, in positions 1-12) sample presented in the 1536 sample plate format. FIG. 14B is the DART API PE (with a 2.5 mm exit cap) mass chromatogram for lidocaine (SIM 235.2±0.5 Da) present in a 200 nL volume of a mixture of caffeine (1 mg/mL), cocaine (1 mg/mL), and methadone (1 mg/mL), applied to a mesh (twelve (12) replicates, in positions 1-12) sample presented in the 1536 sample plate format. FIG. 14C is the DART API PE (with a 2.5 mm exit cap) mass chromatogram for cocaine (SIM 304.3±0.5 Da) present in a 200 nL volume of a mixture of caffeine (1 mg/mL), lidocaine (1 mg/mL), and methadone (1 mg/mL), applied to a mesh (twelve (12) replicates, in positions 1-12) sample presented in the 1536 sample plate format. FIG. 14D is the DART API PE (with a 2.5 mm exit cap) mass chromatogram for methadone (SIM 310.2±0.5 Da) present in a 200 nL volume of a mixture of caffeine (1 mg/mL), lidocaine (1 mg/mL), and cocaine (1 mg/mL), applied to a mesh (twelve (12) replicates, in positions 1-12) sample presented in the 1536 sample plate format. FIG. 14E is the DART API PE (with a 2.5 mm exit cap) TIC for methadone (1 mg/mL), caffeine (1 mg/mL), lidocaine (1 mg/mL), and cocaine (1 mg/mL) samples applied to a mesh (twelve (12) replicates, in positions 1-12) sample presented in the 1536 sample plate format. API The process of API involves the initial action of ionizing a gas by an electrical discharge. In plasma-based API, the electrical discharge of inert gases such as nitrogen, argon and helium lead to the formation of ionized gas molecules, atoms, and metastable molecules and atoms. These charged and energetic particles exit the ionization source where they interact with the molecules in air including background chemicals. Ions are formed during that interaction. Those ions are usually (i) intact protonated or deprotonated molecules such as $NO^+$, $O_2^-$, $H_3O^+$, (ii) clusters of water molecules with one proton, and (iii) ions derived from the molecules present in the ambient air including background chemicals. API becomes an analytical tool when those protonated water molecules interact with analytes present in the air resulting in transfer of the proton to the analyte. The analyte can enter the ionizing species by introduction of the analyte as a gas, liquid or solid, positioned in the path of the products of the electrical discharge of the gas. Two forms of API are Atmospheric Pressure Chemical Ionization (APCI) using an electrical discharge between a high voltage needle and a surface to which the sample has been applied, and Direct Analysis in Real Time (DART) using an electrical discharge and heated gas which desorbs the sample from a surface into the atmosphere (DART API). In absence of a sample, the molecules present in the ambient air become ionized and when detected generate a mass spectrum.

In many cases the purposeful introduction of a sample into the ionizing species results in formation of an ion that is easily measured by using a spectrometer positioned in close proximity to the site of the API.

In the case of biological samples certain molecules present possess very high proton affinity meaning that their purposeful introduction into the ionizing species results in their ionization and formation of ionized dimers containing two of the molecules and a proton. High proton affinity molecule can also combine with another molecule or some closely related molecule forming a mixed dimer or tetramer in the protonated form. The affinity for these molecules for protons prohibits the use of the ionizing method as an analytical method since other molecule of interest in the sample cannot remain un-ionized and are thus not detected using a spectrometer positioned in close proximity to the site of the API. In the API experiments the domination of the resulting spectra by one molecule or collection of high proton affinity molecules is commonly identified as an experiment where the matrix effect is present.

In theory, during ambient ionization the analyte or molecule of interest may not be detected when the sample being analyzed contains background species that ionize more efficiently than the analyte. The detection of the molecule of interest is compromised as the character of the background chemicals becomes more competitive. Without wishing to be bound by theory, it is believed that as the affinity of the background chemical for the ionizing species increases, the detection of the molecule of interest becomes compromised decreasing the efficiency of detection of the molecule of interest. This is a manifestation of the 'matrix effect', a condition in API that can prevent use of the method for analysis. There are a number of background chemicals that cause matrix effects in specific circumstances. For example, the presence of urea in urine and nicotinamide in tobacco products are examples where the background chemicals dominate the spectra produced to the point where they prohibit reliable detection of other chemicals in the sample.

In an embodiment of the invention, the amount of ionizing species generated can be increased by changing from a 1.0 mm exit cap to a 2.5 mm exit cap. Similarly, the amount of ionizing species generated can be increased by changing from DART API HE or DART API PE to DART API CIE. Unexpectedly, it was observed that the sensitivity could be increased using DART API PE with a 2.5 mm exit cap compared with DART API CIE with the 2.5 mm exit cap. Without wishing to be bound by theory, it is believed that the reduced ionizing species due to the use of DART API PE results in a narrow time packet of ionizing species which allow less time for competition between analyte species and background species resulting in an increase in formation of analyte ions. That this requires the wider hole and shorter distance to the sample suggests that the reduced ionizing species can be offset and that the wider hole and/or shorter distance facilitates more of the packet of ionizing species being directed at the sample.

FIGS. 2A and 2B show an API source (110) where the ionizing species exits the distal end of the source through a cap (117, 118) and interacts with molecules present in the ambient atmosphere which result in the production of ions. The ions and neutral gases are drawn from the ionizing region (120) surrounding the sample applied to a surface (130) to the spectrometer (170) by the action of a vacuum applied to the proximal end of a transfer tube (140) to which a vacuum has been applied at the distal end (150), either by the spectrometer (170) or an external vacuum pump (180). In an embodiment of the invention, the gas containing ions enter a gas ion separator at its proximal end of the transfer tube (140) and travel towards the entrance of the entrance region (160) containing the spectrometer inlet tube (165) and there drawn into the spectrometer (170) by either the vacuum of the spectrometer (170) or a combination of that vacuum and the vacuum of an external pump (180). The volume of gas containing ions passing through the spectrometer inlet tube (165) into the volume of the spectrometer (170) can be analyzed to permit detection and characterization of the ions. The mass spectrum generated from a mesh with no sample applied is dominated by ions generated from low mass molecules present in the atmosphere and persistent organic molecules from the production of plastics and other chemicals. In an experimental test, introduction of a sample involves either directing a gas of interest, or positioning of a sample of interest on a surface (130) which is then positioned in the ionization region (120) between the source (110) and spectrometer (170) and which typically results in an immediate change in the appearance of the spectra.

Example 1

A MOSQUITO® robot (TTP Labtech, Cambridge, UK) was used to deposit eight (8) samples onto a first QUICKSTRIP® (IonSense Inc., Saugus, Mass.) wire mesh screen using a twelve (12) well format. The samples (200 nL of a mixture of cocaine (0.01 mg/mL), fentanyl (0.01 mg/mL), and codeine (0.01 mg/mL)) were deposited in positions 3, 4, 5, 6, 7, 8, 9, and 10 as indicated in FIG. 1. The first QuickStrip (90) was prepared. The linear rail (20) holding the sample card (40) in which the laser cut stainless steel mesh (50) was located was inserted into the blank (30) and set to scan at a speed of 3 mm/second past each of the twelve (12) analyses spots (1, 2, 3, 4, 5, 6, 7, 8, 9, 10, 11, 12) as indicated in FIG. 1.

Figure 4A:
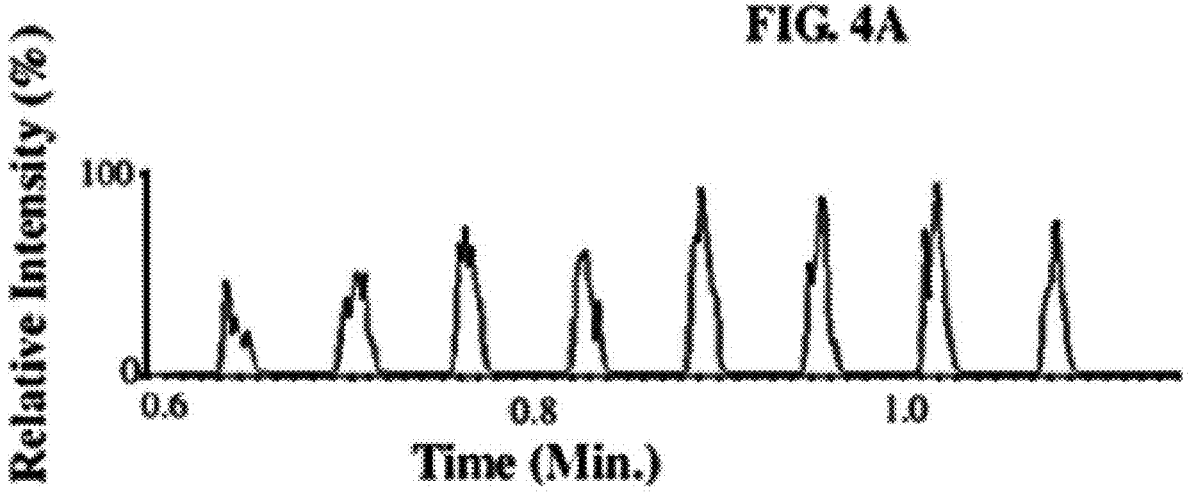
FIG. 4A is a positive DART API CIE mass chromatogram for fentanyl (Single Ion Monitoring (hereinafter SIM) 337.2±0.5 Da) present in a 200 nL volume of a mixture of cocaine (0.01 mg/mL), fentanyl (0.01 mg/mL), and codeine (0.01 mg/mL) applied to a mesh (eight (8) replicates in positions 3-10), in positions 3-10) where the scanning is over all twelve (12) sample locations, acquired using a 1.0 mm exit cap, which shall be referred to hereinafter as '(with a 1.0 mm exit cap)'.
Figure 4B:
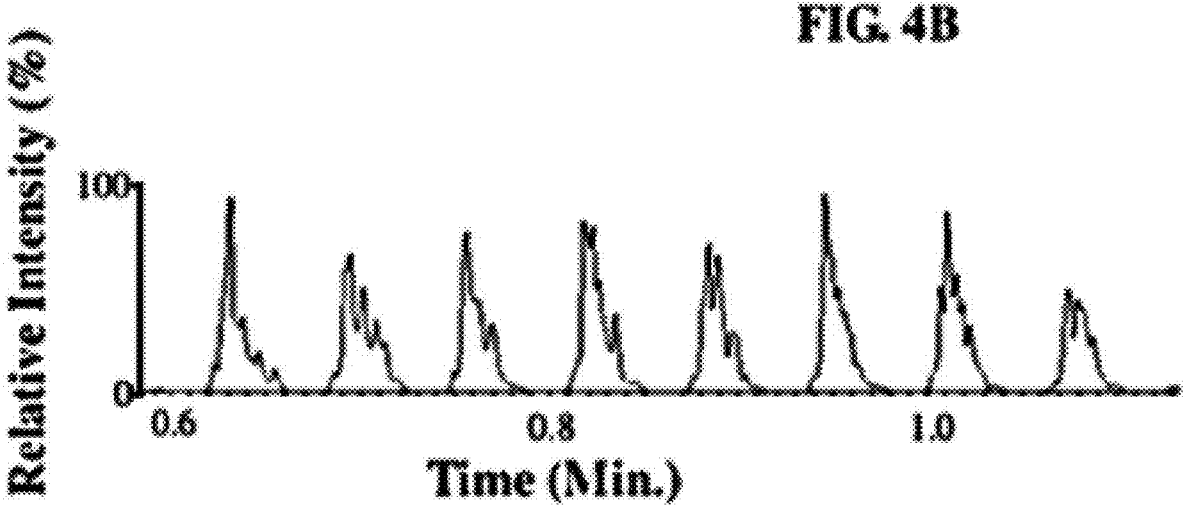
FIG. 4B is a positive DART API CIE (with a 1.0 mm exit cap) mass chromatogram for cocaine (SIM 304.3±0.5 Da) present in a 200 nL volume of a mixture of cocaine (0.01 mg/mL), fentanyl (0.01 mg/mL), and codeine (0.01 mg/mL), and methamphetamine applied to a mesh (eight (8) replicates, replicates in positions 3-10) where the scanning is over all twelve (12) sample locations.
Figure 4C:
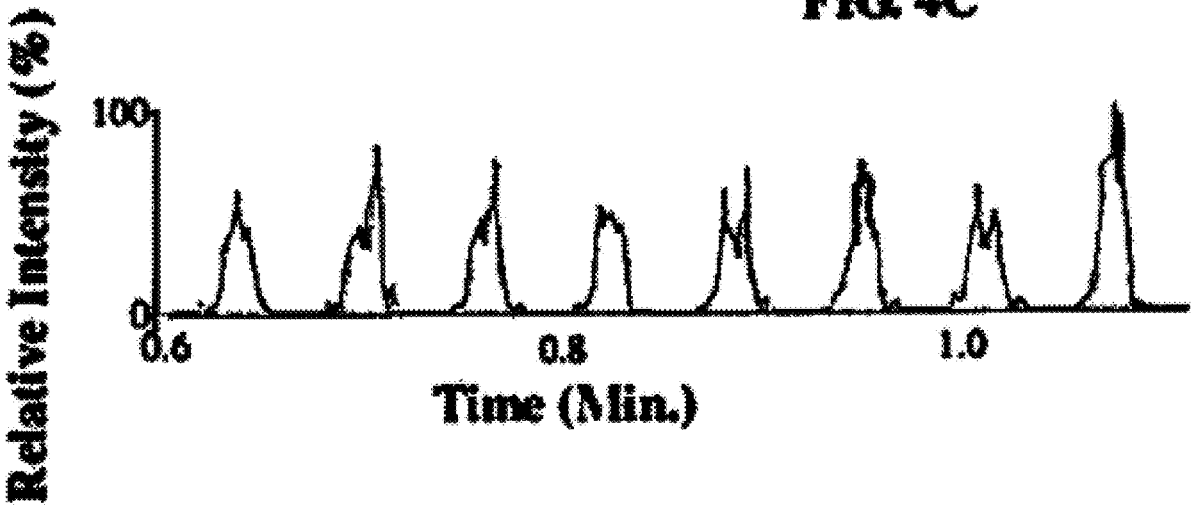
FIG. 4C is a positive DART API CIE (with a 1.0 mm exit cap) mass chromatogram for codeine (SIM 300.3±0.5 Da) present in a 200 nL volume of a mixture of cocaine (0.01 mg/mL), fentanyl (0.01 mg/mL), and codeine (0.01 mg/mL), and methamphetamine applied to a mesh (eight (8) replicates, in positions 3-10) where the scanning is over all twelve (12) sample locations.
Figure 4D:
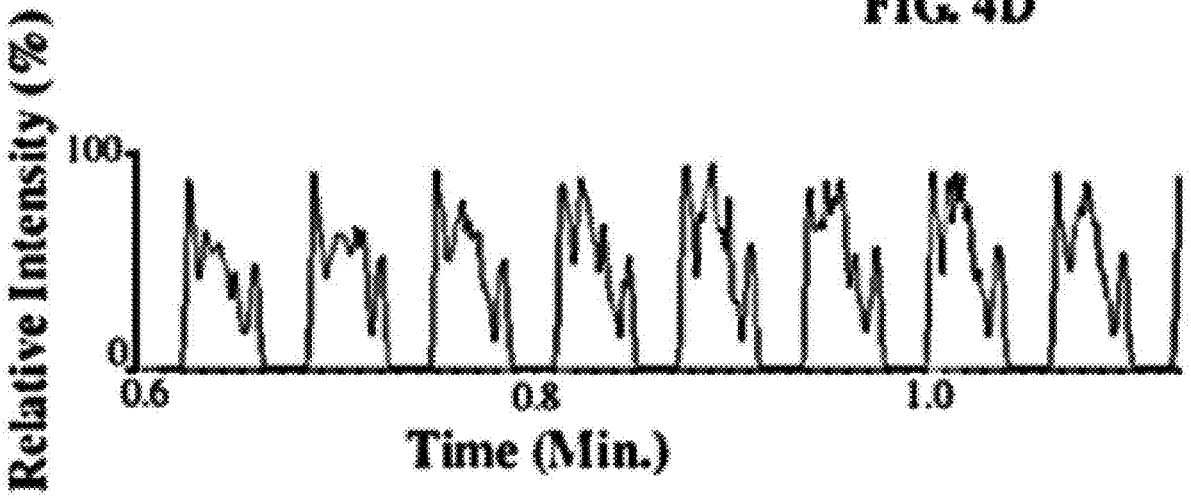
FIG. 4D is a positive DART API CIE (with a 1.0 mm exit cap) total ion current (TIC) trace of 200 nL volume of a mixture of cocaine (0.01 mg/mL), fentanyl (0.01 mg/mL), and codeine (0.01 mg/mL), applied to a mesh (eight (8) replicates, in positions 3-10) where the scanning is over all twelve (12) sample locations.
Figure 10:
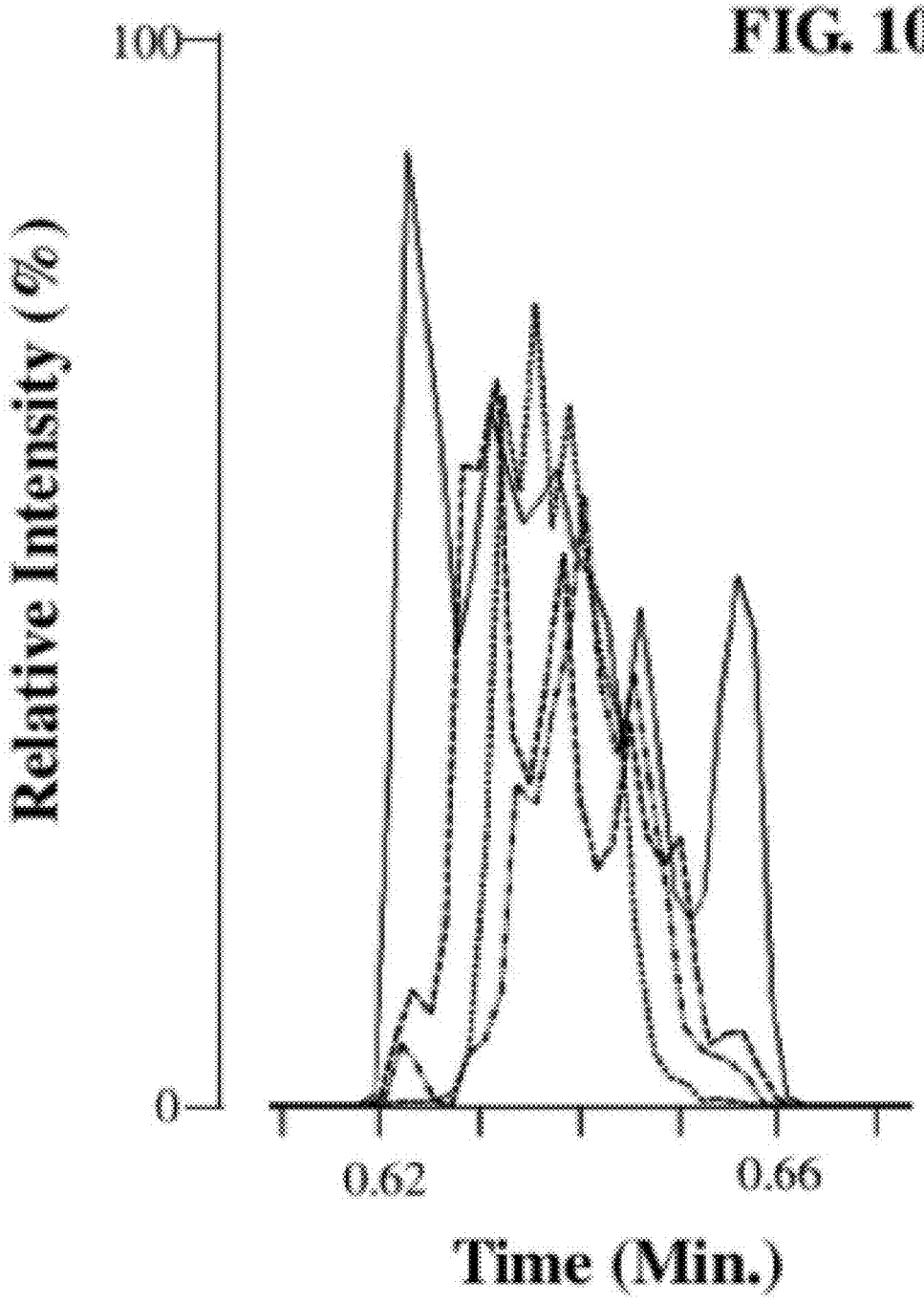
FIG. 10 shows the SIM response between 0.62 and 0.66 minutes shown in FIG. 4A (short dash), FIG. 4B (long dash), FIG. 4C (dash dot dot) compared with FIG. 4D (solid line).

The first QuickStrip (90) was analyzed with a DART API source with helium as the ionizing species set to a temperature of 300° C. for generating precursor ions of the drugs of abuse. FIG. 4A is a positive DART API CIE (1.0 mm exit cap) mass chromatogram for fentanyl (SIM 337.2±0.5 Da). FIG. 4B is a positive DART API DART API CIE (1.0 mm exit cap) mass chromatogram for cocaine (SIM 304.3±0.5 Da). FIG. 4C is a positive DART API DART API CIE (1.0 mm exit cap) mass chromatogram for codeine (SIM 300.3±0.5 Da). FIG. 4D is a positive DART API DART API CIE (1.0 mm exit cap) TIC trace for the ions formed. Significant TIC was observed in analyses spots with no sample applied (1, 2, 11, and 12, see FIG. 1) indicating that ionization of molecules present in the environment (e.g., including phthalates, and perfluoroalkanes) can generate a relatively abundant pool of background species that may reduce the efficiency of the ionization process for molecules of interest once a sample is introduced into the ionization region. As shown in FIG. 10, a comparison of the width of the peaks in the mass chromatograms in FIG. 4A (short dash), FIG. 4B (long dash), FIG. 4C (dash dot dot) with the width of the TIC peak in FIG. 4D (solid line) shows that the peaks in FIG. 4D are broader than those observed in FIGS. 4A-4C. Further, the intensity of the TIC trace increases at an earlier time than the SIM in FIGS. 4A-4C. Without wishing to be bound by any theory, it is believed that there is observed a short interval of time where 'unrelated ions' are formed (i.e., ions formed from background chemicals unrelated to the sample) which contribute to the TIC trace. It is proposed that those background chemicals that form the unrelated ions are therefore present and capable of interaction with or competition with the sample for the ionizing species. Reducing the ability of the background chemicals to compete with the sample therefore increases the sensitivity of analysis of the sample.

Example 2

The Mosquito robot was used to deposit identical samples to Example 1 on a second QuickStrip.

The second QuickStrip was then analyzed with a DART API source operated as in Example 1, but with a 2.5 mm exit cap.

Figure 5A:
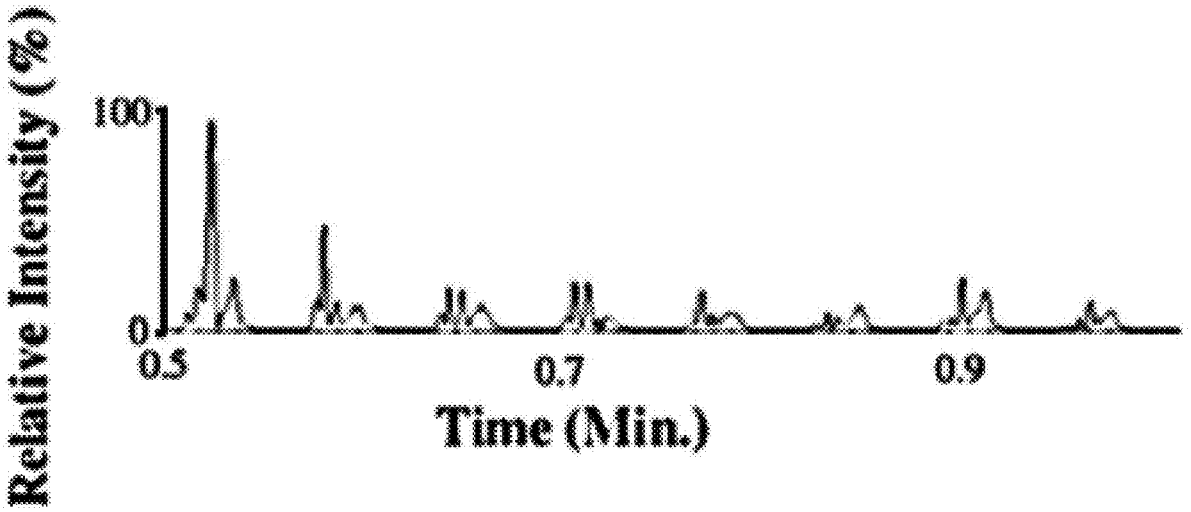
FIG. 5A is a positive DART API CIE mass chromatogram for fentanyl (SIM 337.2±0.5 Da) present in a 200 nL volume of a mixture of cocaine (0.01 mg/mL), fentanyl (0.01 mg/mL), and codeine (0.01 mg/mL) applied to a mesh (eight (8) replicates in positions 3-10) where the scanning is over all twelve (12) sample locations, acquired using a 2.5 mm exit cap, which shall be referred to hereinafter as '(with a 2.5 mm exit cap).
Figure 5B:
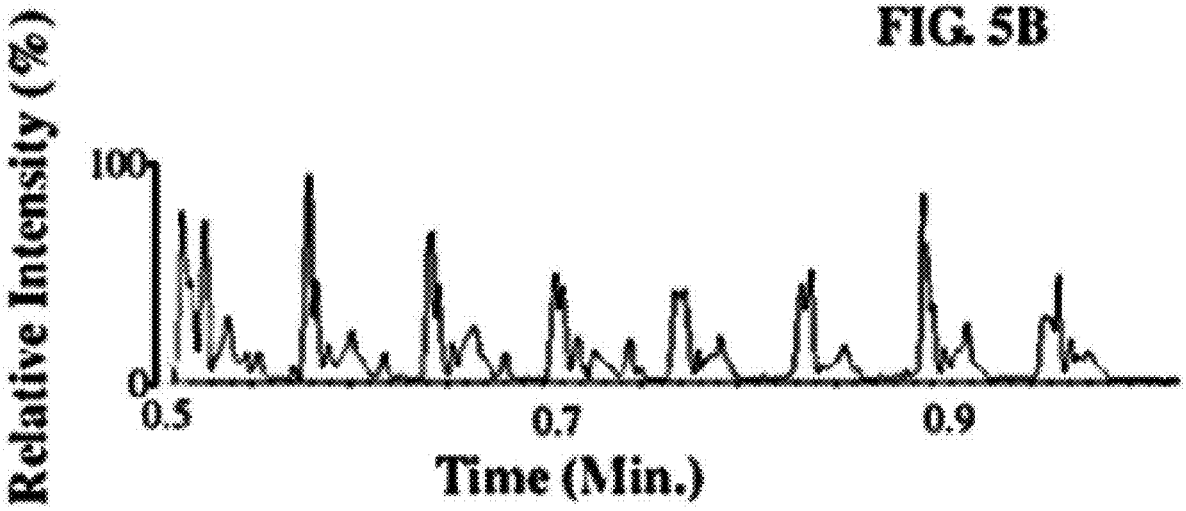
FIG. 5B is a positive DART API CIE (with a 2.5 mm exit cap) mass chromatogram for cocaine (SIM 304.3±0.5 Da) present in a 200 nL volume of a mixture of cocaine (0.01 mg/mL), fentanyl (0.01 mg/mL), and codeine (0.01 mg/mL), applied to a mesh (eight (8) replicates, in positions 3-10) where the scanning is over all twelve (12) sample locations.
Figure 5C:
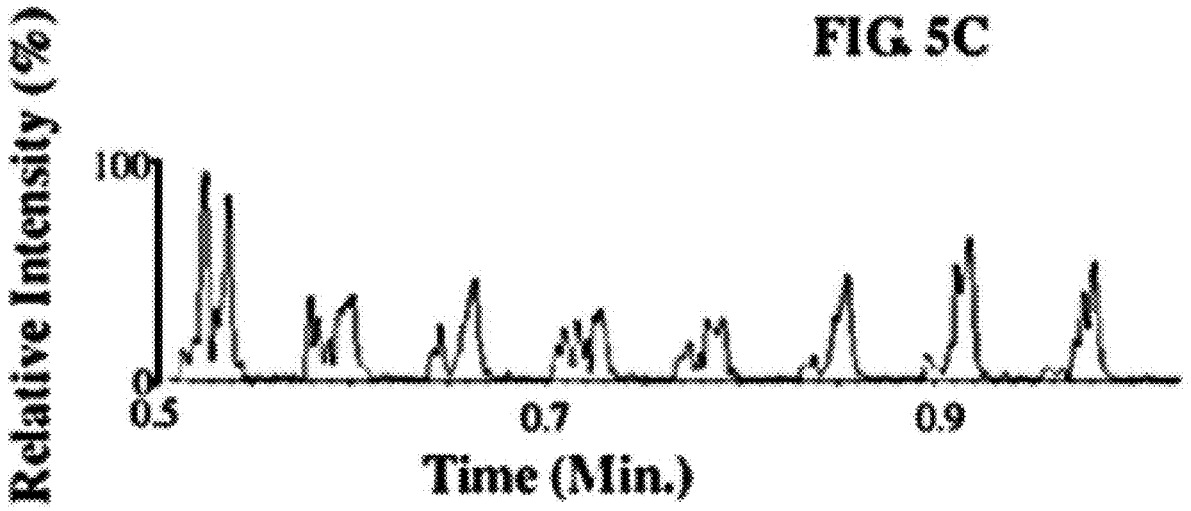
FIG. 5C is a positive DART API CIE (with a 2.5 mm exit cap) mass chromatogram for codeine (SIM 300.3±0.5 Da) present in a 200 nL volume of a mixture of cocaine (0.01 mg/mL), fentanyl (0.01 mg/mL), and codeine (0.01 mg/mL), and methamphetamine applied to a mesh (eight (8) replicates, in positions 3-10) where the scanning is over all twelve (12) sample locations.
Figure 5D:
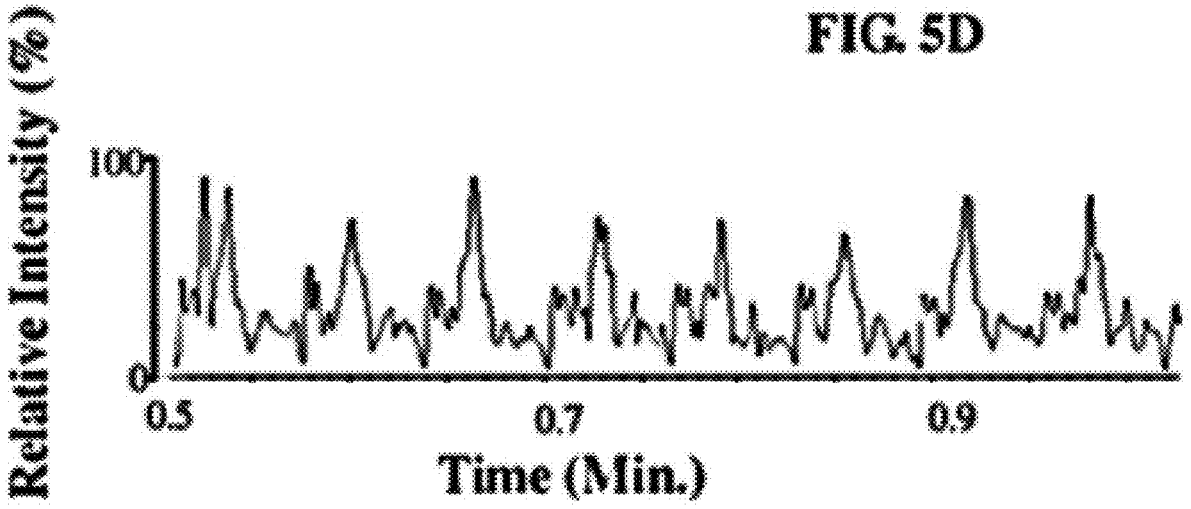
FIG. 5D is a positive DART API CIE (with a 2.5 mm exit cap) TIC trace of 200 nL volume of a mixture of cocaine (0.01 mg/mL), fentanyl (0.01 mg/mL), and codeine (0.01 mg/mL), applied to a mesh (eight (8) replicates, in positions 3-10) where the scanning is over all twelve (12) sample locations.

FIG. 5A is a positive DART API CIE (2.5 mm exit cap) mass chromatogram for fentanyl (SIM 337.2±0.5 Da). FIG. 5B is a positive DART API CIE (2.5 mm exit cap) mass chromatogram for cocaine (SIM 304.3±0.5 Da). FIG. 5C is a positive DART API CIE (2.5 mm exit cap) mass chromatogram for codeine (SIM 300.3±0.5 Da). FIG. 5D is a positive DART API CIE (2.5 mm exit cap) TIC trace for all ions produced from the mesh as a function of the sample position on the mesh. A comparison of the TIC acquired using the 1.0 mm exit cap (FIG. 4D) with the TIC acquired using the 2.5 mm exit cap (FIG. 5D) demonstrates that the area of ionization is increased as the cap size increases. That the gas volume exiting the cap increases and results in a near constant production of ions from background as well as sample means that prior to the sample being ionized there is a large abundance of ions related to background present in the ionization region. The production of ions is nearly constant despite the presence of the physical barrier imposed by the metal tines present between each of the individual positions (see blank 30 between positions 1-12 in FIG. 1). The narrow cap is observed to provide a more efficient production of ions for analysis but it does not limit the production of background species and therefore it does not reduce the competition between the background species and sample related ions. Once again comparison of the width of the peaks in the mass chromatograms in FIGS. 5A-5C with the width of the peaks in the TIC (FIG. 5D) shows that the analysis of each sample is preceded by a near continuous time period where ions unrelated to the sample are present and those background chemicals therefore are present and capable of interaction with or competition for the ionizing species.

Example 3

The Mosquito robot was used to deposit identical samples to Example 1 on a third QuickStrip.

The third QuickStrip was then analyzed with a DART API source operated as in Example 1, with DART API HE in which samples were presented discontinuously where the ionizing species is off prior to presentation of the first sample, initiated when the sample is presented and moving at 3 mm/second for one (1) second and then discontinued until the second sample is presented for analysis where the pulse gas and movement process is repeated for all twelve (12) samples.

Figure 6A:
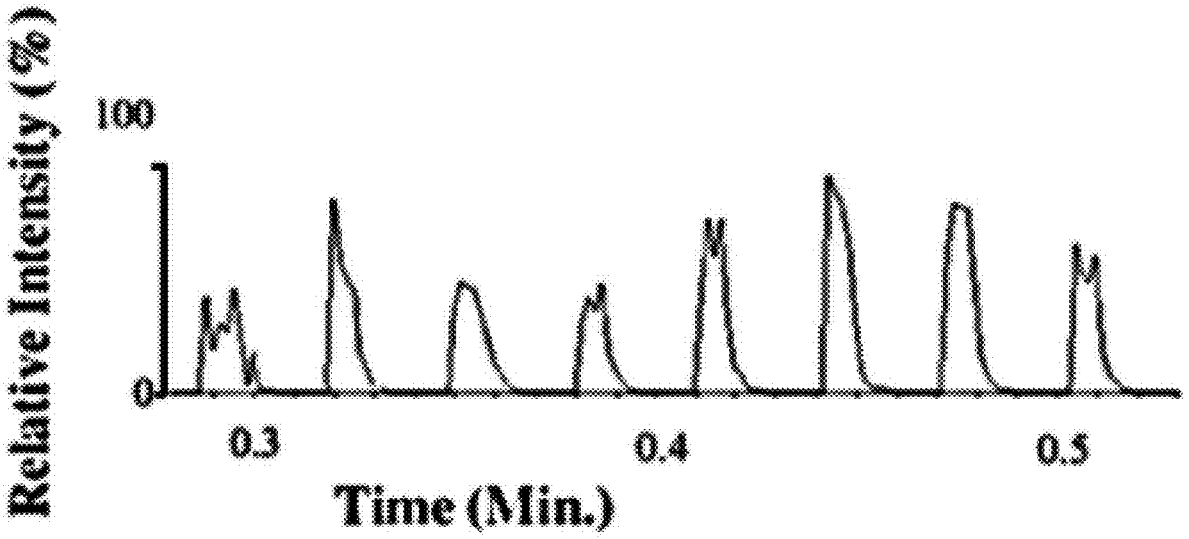
FIG. 6A is a positive DART API HE mass chromatogram (with a 1.0 mm exit cap) for fentanyl (SIM 337.2±0.5 Da) present in a 200 nL volume of a mixture of cocaine (0.01 mg/mL), fentanyl (0.01 mg/mL), and codeine (0.01 mg/mL) applied to a mesh (eight (8) replicates, in positions 3-10), where the HE is performed for all 12 sample locations, according to an embodiment of the invention.
Figure 6B:
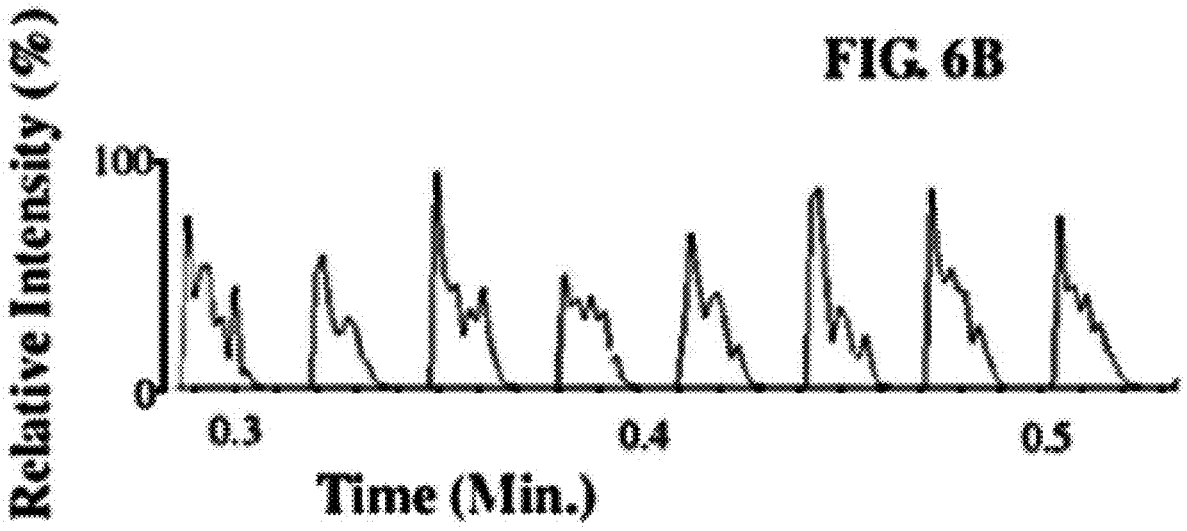
FIG. 6B is a positive DART API HE (with a 1.0 mm exit cap) mass chromatogram for cocaine (SIM 304.3±0.5 Da) present in a 200 nL volume of a mixture of cocaine (0.01 mg/mL), fentanyl (0.01 mg/mL), and codeine (0.01 mg/mL), applied to a mesh (eight (8) replicates, in positions 3-10) where the HE is performed for all 12 sample locations, according to an embodiment of the invention.
Figure 6C:
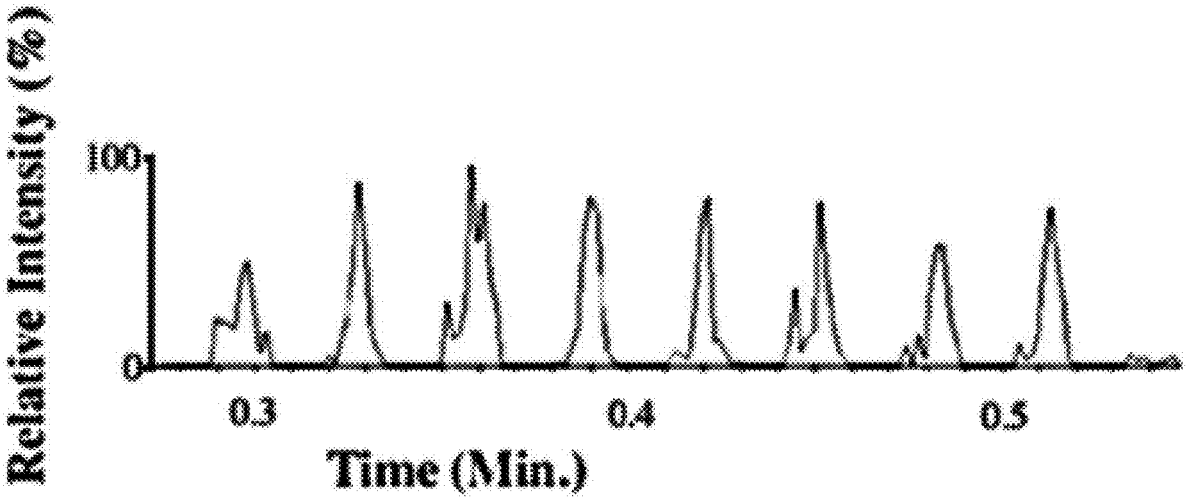
FIG. 6C is a positive DART API HE (with a 1.0 mm exit cap) mass chromatogram for codeine (SIM 300.3±0.5 Da) present in a 200 nL volume of a mixture of cocaine (0.01 mg/mL), fentanyl (0.01 mg/mL), and codeine (0.01 mg/mL), and methamphetamine applied to a mesh (eight (8) replicates, in positions 3-10) where the HE is performed for all 12 sample locations, according to an embodiment of the invention.
Figure 6D:
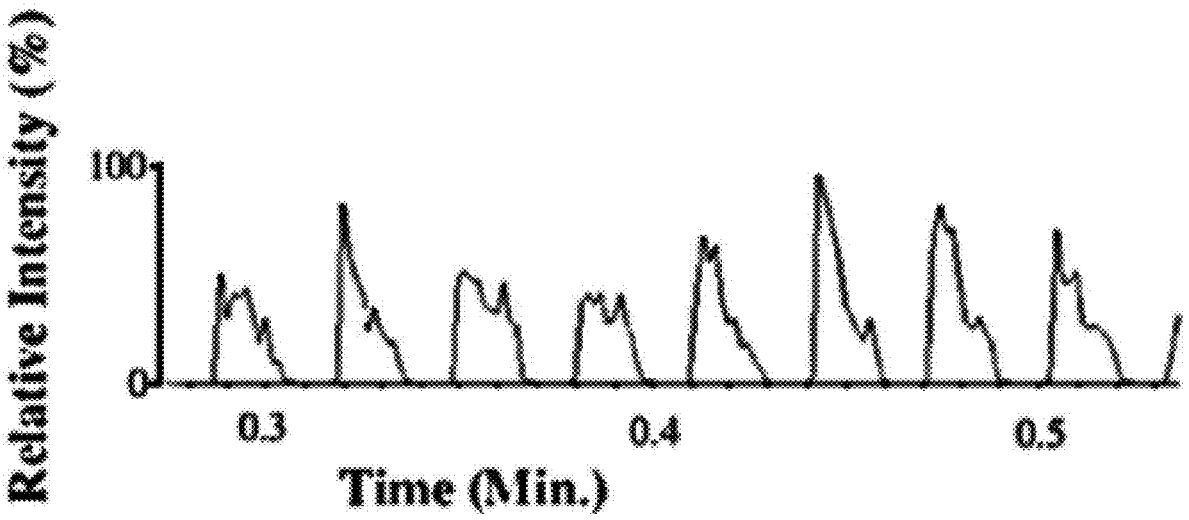
FIG. 6D is a positive DART API HE (with a 1.0 mm exit cap) TIC trace of 200 nL volume of a mixture of cocaine (0.01 mg/mL), fentanyl (0.01 mg/mL), and codeine (0.01 mg/mL), applied to a mesh (eight (8) replicates, in positions 3-10) where the HE is performed for all 12 sample locations, according to an embodiment of the invention.
Figure 11A:
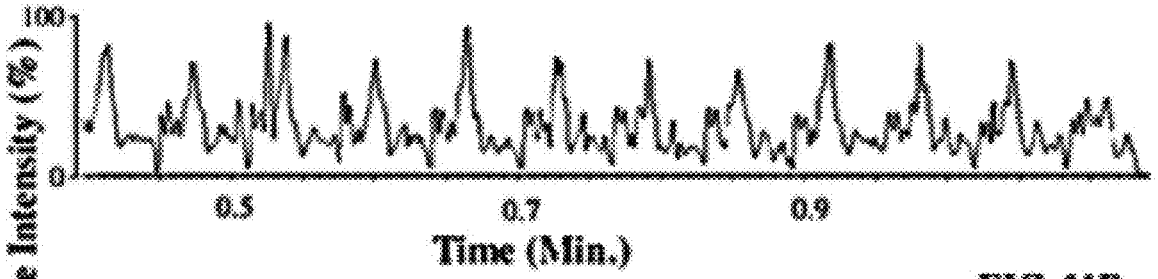
FIG. 11A is the DART API CIE (with a 2.5 mm exit cap) TIC, where the sample is a 200 nL volume of a mixture of cocaine (0.01 mg/mL), fentanyl (0.01 mg/mL), and codeine (0.01 mg/mL), applied to a mesh (eight (8) replicates, in positions 3-10.
Figure 11B:
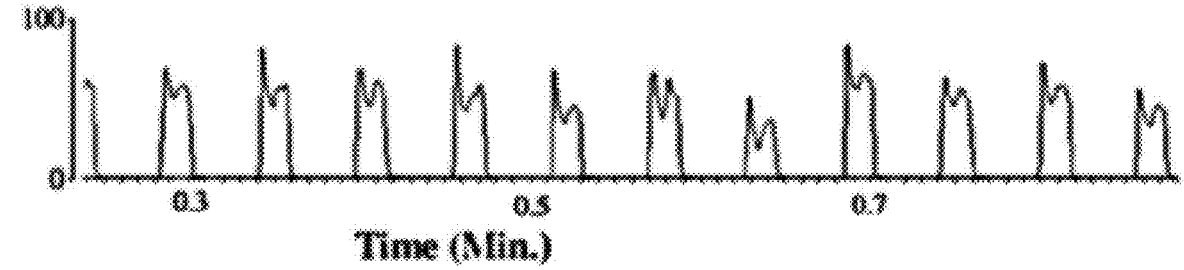
FIG. 11B is the DART API PE TIC (with a 2.5 mm exit cap), where the sample is a 200 nL volume of a mixture of cocaine (0.01 mg/mL), fentanyl (0.01 mg/mL), and codeine (0.01 mg/mL), applied to a mesh (eight (8) replicates, in positions 3-10), according to an embodiment of the invention.
Figures 12A, 12B:
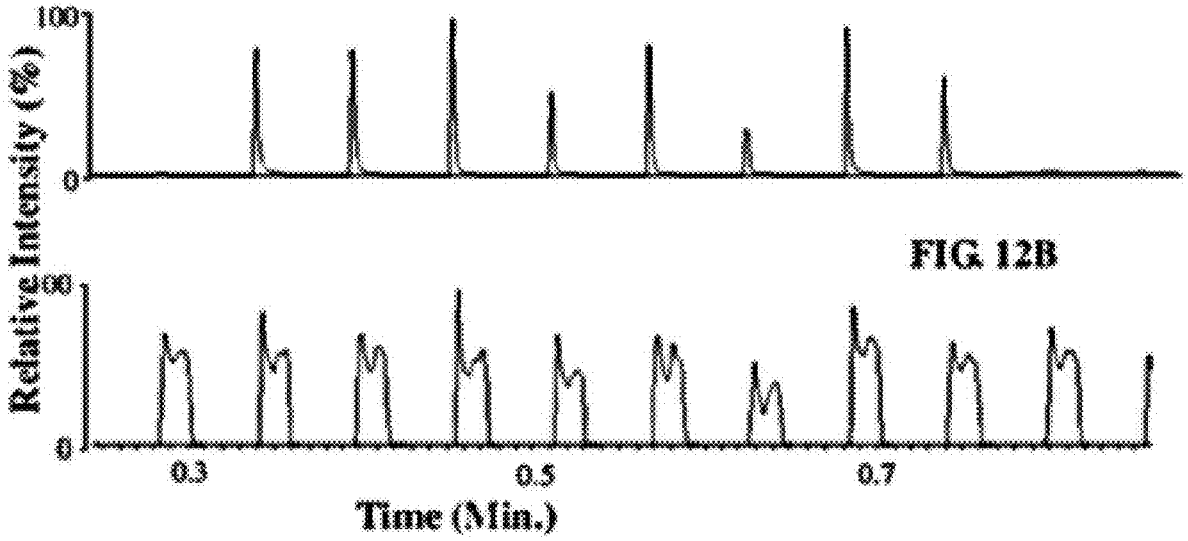
FIG. 12A is the DART API PE (with a 2.5 mm exit cap) mass chromatogram for fentanyl (SIM 337.2±0.5 Da) of 200 nL volume of a mixture of cocaine (0.01 mg/mL), fentanyl (0.01 mg/mL), and codeine (0.01 mg/mL), applied to a mesh (eight (8) replicates, in positions 3-10), according to an embodiment of the invention.
FIG. 12B is the DART API PE (with a 2.5 mm exit cap) TIC trace of 200 nL volume of a mixture of cocaine (0.01 mg/mL), fentanyl (0.01 mg/mL), and codeine (0.01 mg/mL), applied to a mesh (eight (8) replicates, in positions 3-10) where samples are presented as in FIG. 12A, according to an embodiment of the invention.

FIG. 6A is a positive DART API HE (1.0 mm exit cap) mass chromatogram for fentanyl (SIM 337.2±0.5 Da). FIG. 6B is a positive DART API HE (1.0 mm exit cap) mass chromatogram for cocaine (SIM 304.3±0.5 Da). FIG. 6C is a positive DART API HE (1.0 mm exit cap) mass chromatogram for codeine (SIM 300.3±0.5 Da). FIG. 6D is a positive DART API HE (1.0 mm exit cap) TIC trace for all of the ions formed. In analyzing a sample it is assumed that the more sample present the greater the signal intensity that is observed. Further, more sample ions can be desorbed by moving the sample through the ionizing species as a function of time in order that more of the sample is exposed to the ionizing conditions. Both these assumptions are questioned by the results presented. In the DART API HE (1.0 mm exit cap) movement of the sample occurs with the ionizing species pressure turned off until the position of the mesh relative to the source is such that the ionizing species is directed at the sample. Simultaneous activation of carrier gas pressure in the ionization source and movement of the mesh to present the sample is for a short period of time. Comparison of the width of the peaks in the mass chromatograms in FIGS. 6A, 6B, 6C with the width of the peaks in the TIC (FIG. 6D) shows that there is an absence of background chemical related ions prior to introduction of the sample (see FIG. 11). That is the sample analysis period is not preceded by a near continuous time period where ions unrelated to the sample are present. Inspection of the shape of the peaks in the mass chromatograms in FIGS. 5A, 5B, 5C and the TIC (FIG. 5D) shows that ions unrelated to the sample are present as the sample moves. For example tailing of each peak is observed, indicating that the sample ions are competing with background chemical molecules for the ionizing species.

Example 4

The Mosquito robot was used to deposit identical samples to Example 1 on a fourth QuickStrip.

The fourth QuickStrip was then analyzed with a DART API source operated as in Example 3, but with a 2.5 mm exit cap.

Figure 7A:
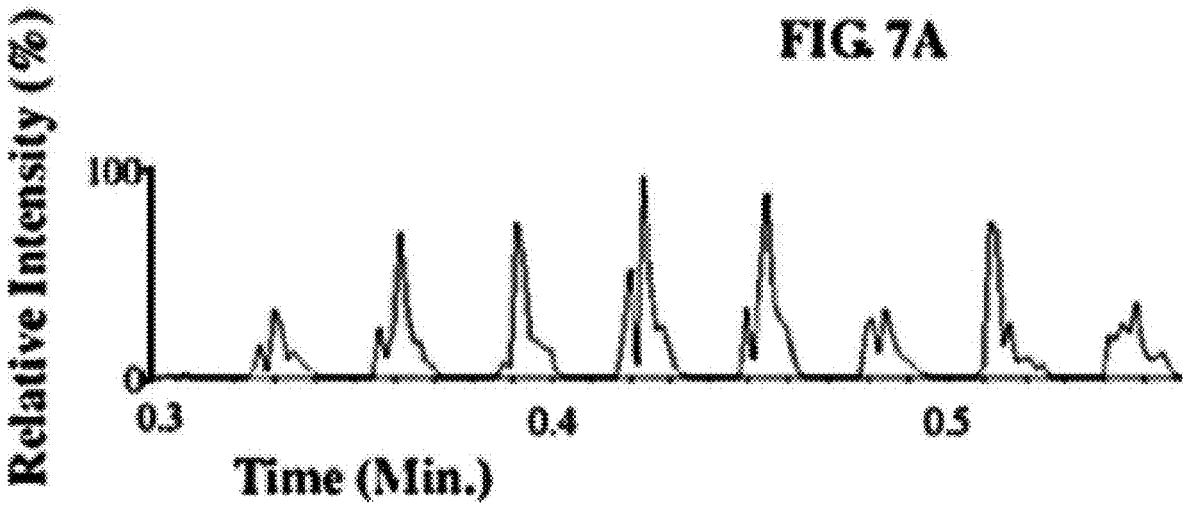
FIG. 7A is a positive DART API HE (with a 2.5 mm exit cap) mass chromatogram for fentanyl (SIM 337.2±0.5 Da) present in a 200 nL volume of a mixture of cocaine (0.01 mg/mL), fentanyl (0.01 mg/mL), and codeine (0.01 mg/mL) applied to a mesh (eight (8) replicates, in positions 3-10) where the HE is performed for all 12 sample locations, according to an embodiment of the invention.
Figure 7B:
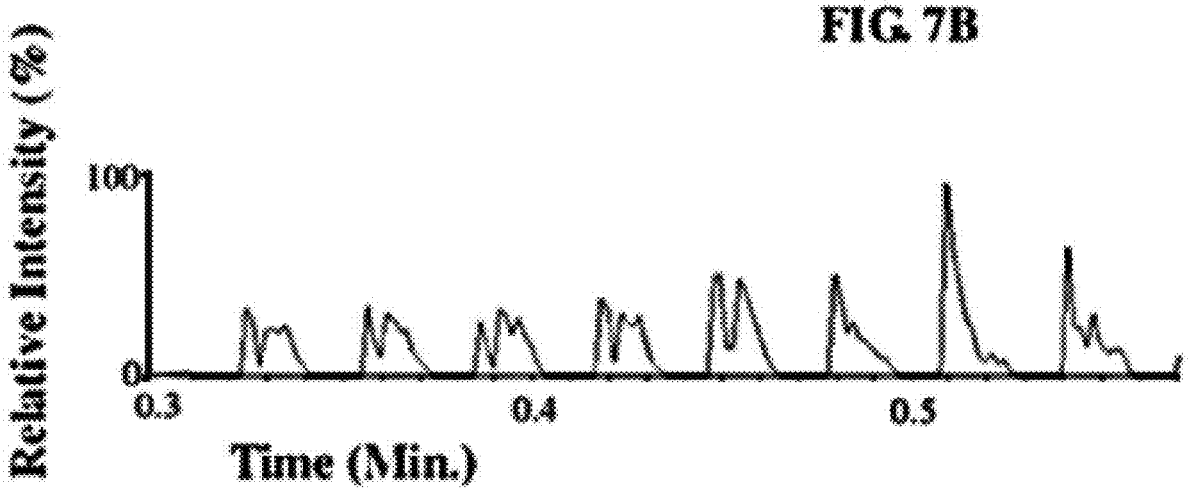
FIG. 7B is a positive DART API HE (with a 2.5 mm exit cap) mass chromatogram for cocaine (SIM 304.3±0.5 Da) present in a 200 nL volume of a mixture of cocaine (0.01 mg/mL), fentanyl (0.01 mg/mL), and codeine (0.01 mg/mL), applied to a mesh (eight (8) replicates, in positions 3-10) where the HE is performed for all 12 sample locations, according to an embodiment of the invention.
Figure 7C:
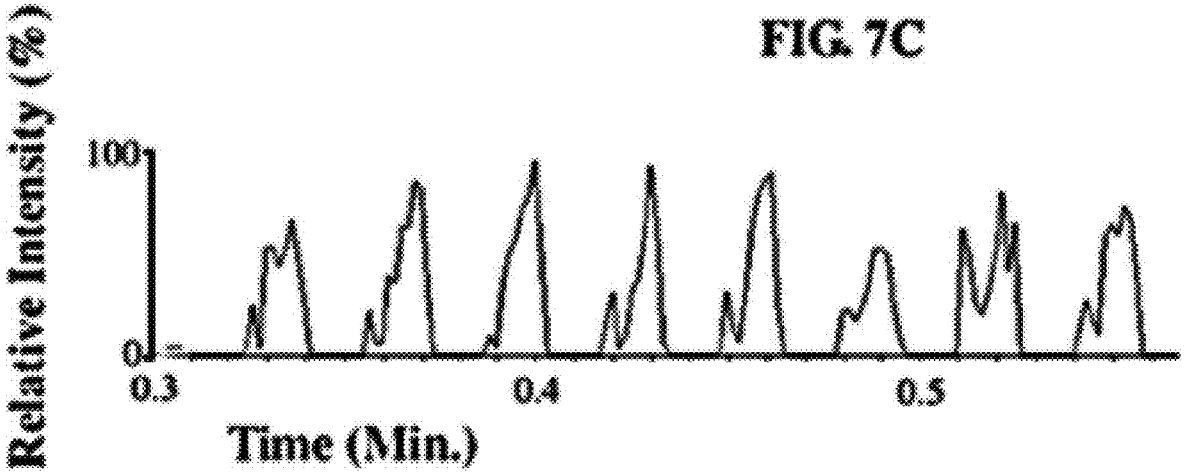
FIG. 7C is a positive DART API HE (with a 2.5 mm exit cap) mass chromatogram for codeine (SIM 300.3±0.5 Da) present in a 200 nL volume of a mixture of cocaine (0.01 mg/mL), fentanyl (0.01 mg/mL), and codeine (0.01 mg/mL), and methamphetamine applied to a mesh (eight (8) replicates, in positions 3-10) where the HE is performed for all 12 sample locations, according to an embodiment of the invention.
Figure 7D:
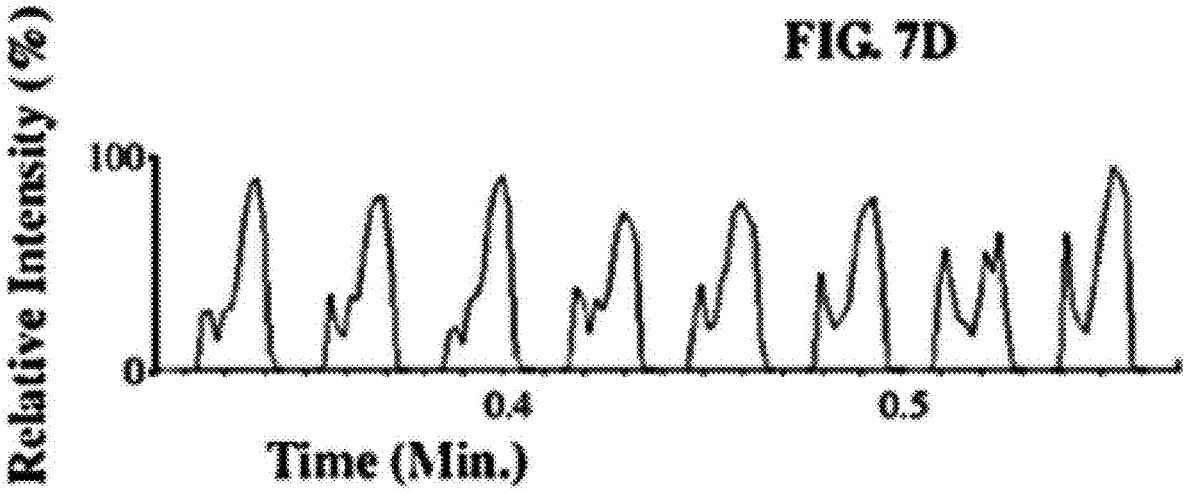
FIG. 7D is a positive DART API HE (with a 2.5 mm exit cap) TIC trace of 200 nL volume of a mixture of cocaine (0.01 mg/mL), fentanyl (0.01 mg/mL), and codeine (0.01 mg/mL), applied to a mesh (eight (8) replicates, in positions 3-10) where the HE is performed for all 12 sample locations, according to an embodiment of the invention.

FIG. 7A is a positive DART API HE (2.5 mm exit cap) mass chromatogram for fentanyl (SIM 337.2±0.5 Da). FIG. 7B is a positive DART API HE (2.5 mm exit cap) mass chromatogram for cocaine (SIM 304.3±0.5 Da). FIG. 7C is a positive DART API HE (2.5 mm exit cap) mass chromatogram for codeine (SIM 300.3±0.5 Da). FIG. 7D is a positive DART API HE (2.5 mm exit cap) TIC trace for all of the ions formed from the mesh as a function of the sample position on the mesh. A comparison of the TIC acquired using the 1.0 mm exit cap (FIG. 6D) with the TIC acquired using the 2.5 mm exit cap (FIG. 7D) demonstrates that the area of ionization is increased as the cap size increases. In an embodiment of the invention the absence of ions prior to increasing the pressure to force the ionizing species to flow at the mesh has resulted in preferential production of sample related ions The movement of sample into the ionizing species region prior to the time when the pressure is increased to direct the ionizing species at the sample is observed to improve the production of sample related ions. The increase in peak width and the observation that the peak tailing in each of the mass chromatograms is increased relative to the CIE serves to indicate that the production of ions related to background is occurring and those ions are reducing production of sample related ions.

Example 5

The Mosquito robot was used to deposit identical samples to Example 1 on a fourth QuickStrip.

The fifth QuickStrip was then analyzed with a DART API source operated as in Example 1, i.e., with a 1.0 mm exit cap but with DART API PE (i.e., the linear rail was set to jump to each of twelve (12) analyses spots (1, 2, 3, 4, 5, 6, 7, 8, 9, 10, 11, 12) as indicated in FIG. 1 and rest for one (1) second duration after each jump, during which time the helium was pulsed into the DART API source.

Figure 8A:
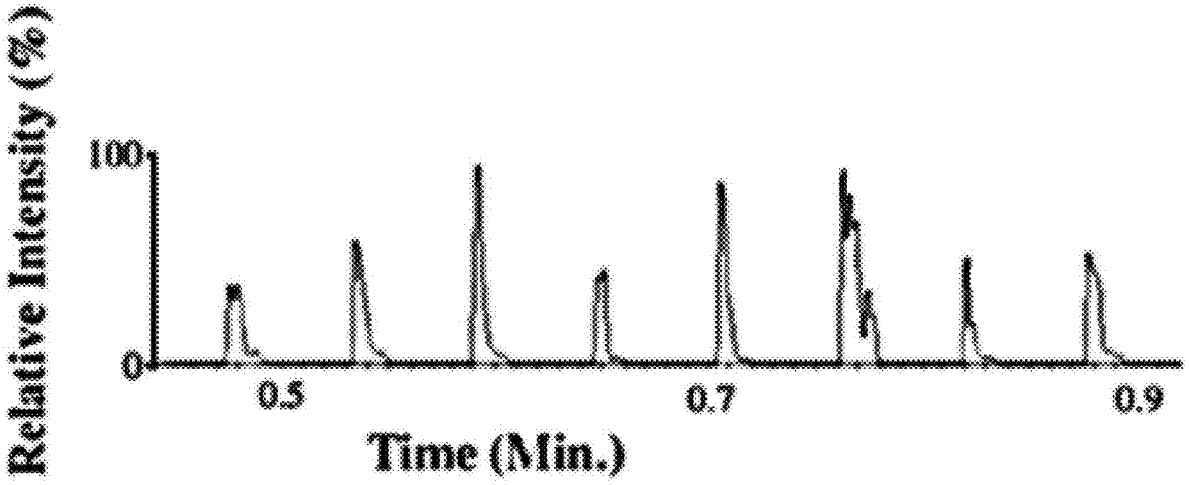
FIG. 8A is a positive DART API PE (with a 1.0 mm exit cap) mass chromatogram, for fentanyl (SIM 337.2±0.5 Da) present in a 200 nL volume of a mixture of cocaine (0.01 mg/mL), fentanyl (0.01 mg/mL), and codeine (0.01 mg/mL) applied to a mesh (eight (8) replicates, in positions 3-10) where the PE is performed for all 12 sample locations, according to an embodiment of the invention.
Figure 8B:
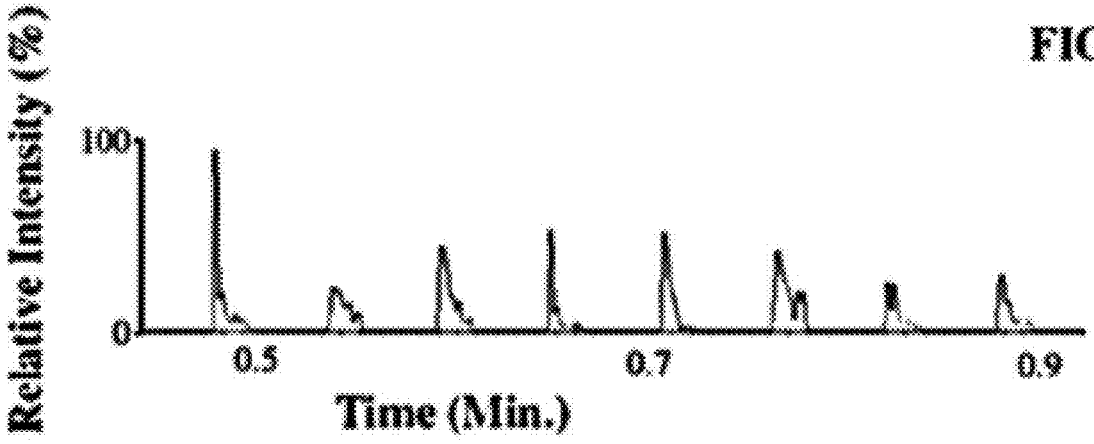
FIG. 8B is a positive DART API PE (with a 1.0 mm exit cap) mass chromatogram for cocaine (SIM 304.3±0.5 Da) present in a 200 nL volume of a mixture of cocaine (0.01 mg/mL), fentanyl (0.01 mg/mL), and codeine (0.01 mg/mL), applied to a mesh (eight (8) replicates, in positions 3-10) where the PE is performed for all 12 sample locations, according to an embodiment of the invention.
Figure 8C:
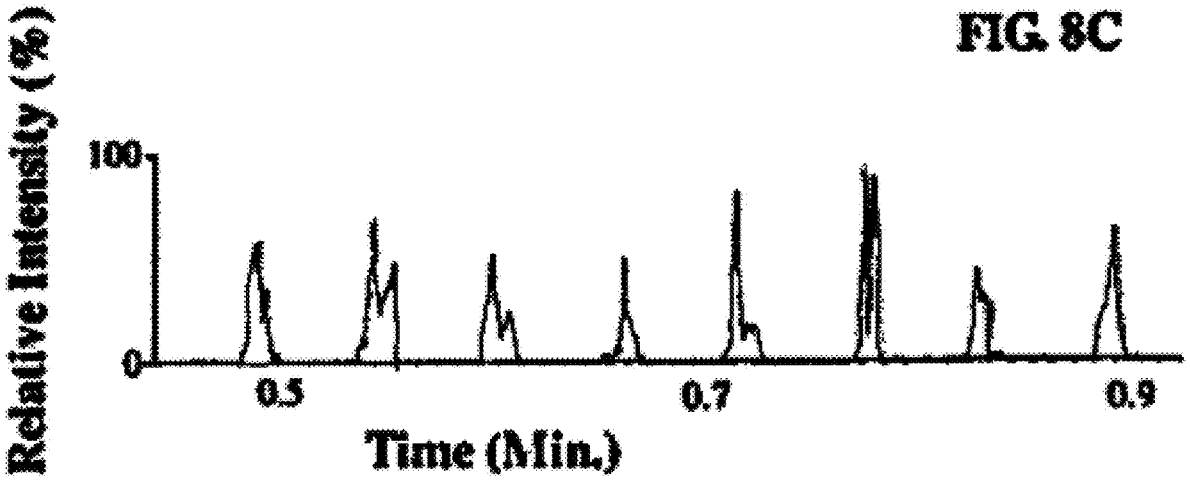
FIG. 8C is a positive DART API PE (with a 1.0 mm exit cap) mass chromatogram for codeine (SIM 300.3±0.5 Da) present in a 200 nL volume of a mixture of cocaine (0.01 mg/mL), fentanyl (0.01 mg/mL), and codeine (0.01 mg/mL), and methamphetamine applied to a mesh (eight (8) replicates, in positions 3-10) where the PE is performed for all 12 sample locations, according to an embodiment of the invention.
Figure 8D:
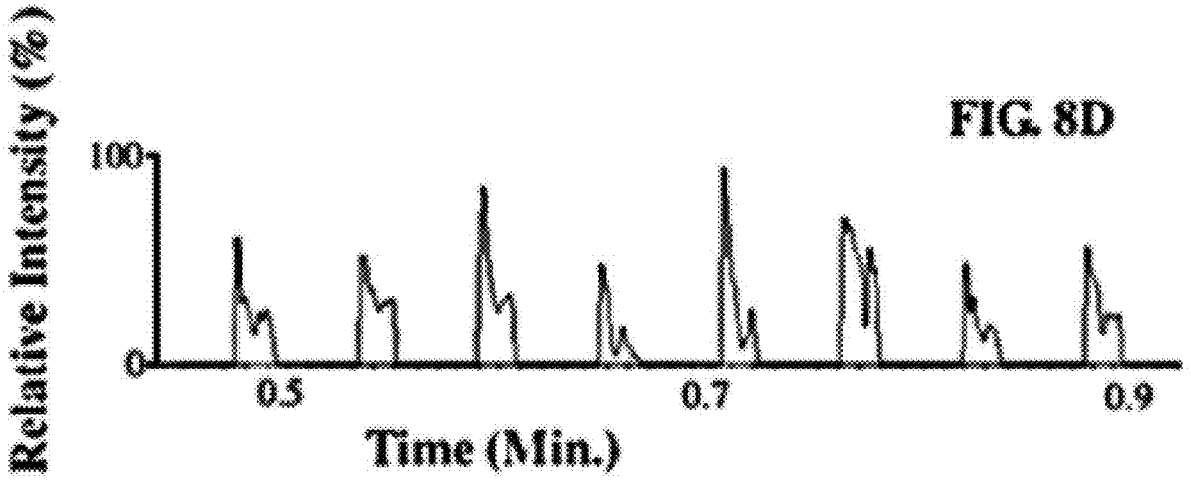
FIG. 8D is a positive DART API PE (with a 1.0 mm exit cap) TIC trace of 200 nL volume of a mixture of cocaine (0.01 mg/mL), fentanyl (0.01 mg/mL), and codeine (0.01 mg/mL), applied to a mesh (eight (8) replicates, in positions 3-10) where the PE is performed for all 12 sample locations, according to an embodiment of the invention.

FIG. 8A is a positive DART API PE (1.0 mm exit cap) mass chromatogram for fentanyl (SIM 337.2±0.5 Da). FIG. 8B is a positive DART API PE (1.0 mm exit cap) mass chromatogram for cocaine (SIM 304.3±0.5 Da). FIG. 8C is a positive DART API PE (1.0 mm exit cap) mass chromatogram for codeine (SIM 300.3±0.5 Da). FIG. 8D is a positive DART API PE (1.0 mm exit cap) TIC trace for the ions formed. In an embodiment of the invention the amount of sample desorbed is increased by completing movement of the sample into position, increasing the pressure applied to the carrier gas for a brief interval and then turning off the carrier gas pressure. Without wishing to be bound by theory, it is believed that the ionizing species are increased when the pulse of carrier gas is applied. Comparison of the width of the peaks in the mass chromatograms in FIGS. 8A-8C with the width of the peaks in the TIC (FIG. 8D) shows that there is an absence of background related ions prior to and only for a short period after the gas pressure has been reduced. The sample analysis period is not preceded by a near continuous time period where ions unrelated to the sample are being produced and the production of ions is limited in time by decreasing the flow of ionizing species effectively reducing the generation of background species as well as sample related ions. Inspection of the shape of the peaks in the mass chromatograms in FIGS. 8A-8C and the TIC (FIG. 8D) show rapid increase in sample related ion production is demonstrated and the use of the pulsed gas method with a stationary sample reduces the potential for tailing of each peak. The absence of background species as indicated by the return of the line to the baseline in the TIC FIG. 8D enables the use of less complex peak detection algorithms which has previously proven difficult to do owing to non-uniform peak shape signals.

Example 6

The Mosquito robot was used to deposit identical samples to Example 1 on a sixth QuickStrip.

The sixth QuickStrip was then analyzed with a DART API source operated as in Example 5, but with a 2.5 mm exit cap.

Figure 9A:
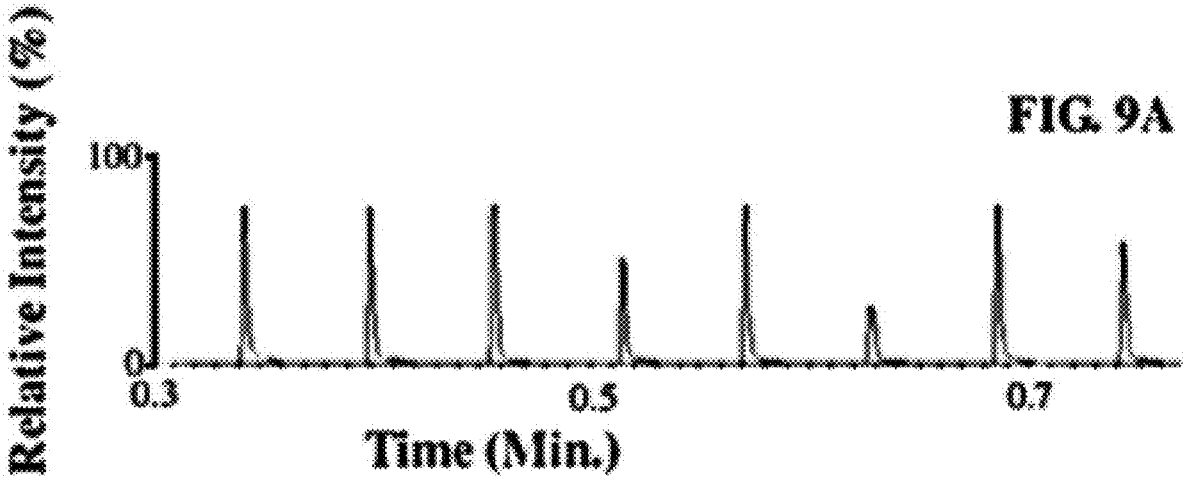
FIG. 9A is a positive DART API PE (with a 2.5 mm exit cap) mass chromatogram for fentanyl (SIM 337.2±0.5 Da) present in a 200 nL volume of a mixture of cocaine (0.01 mg/mL), fentanyl (0.01 mg/mL), and codeine (0.01 mg/mL) applied to a mesh (eight (8) replicates, in positions 3-10) where the PE is performed for all 12 sample locations, according to an embodiment of the invention.
Figure 9B:
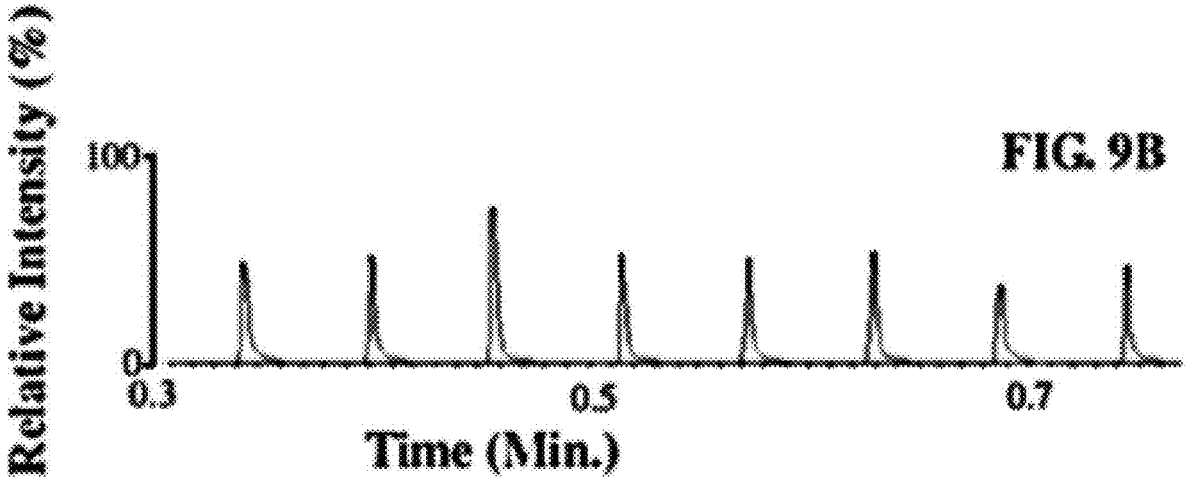
FIG. 9B is a positive DART API PE (with a 2.5 mm exit cap) mass chromatogram for cocaine (SIM 304.3±0.5 Da) present in a 200 nL volume of a mixture of cocaine (0.01 mg/mL), fentanyl (0.01 mg/mL), and codeine (0.01 mg/mL), applied to a mesh (eight (8) replicates, in positions 3-10) where the PE is performed for all 12 sample locations, according to an embodiment of the invention.
Figure 9C:
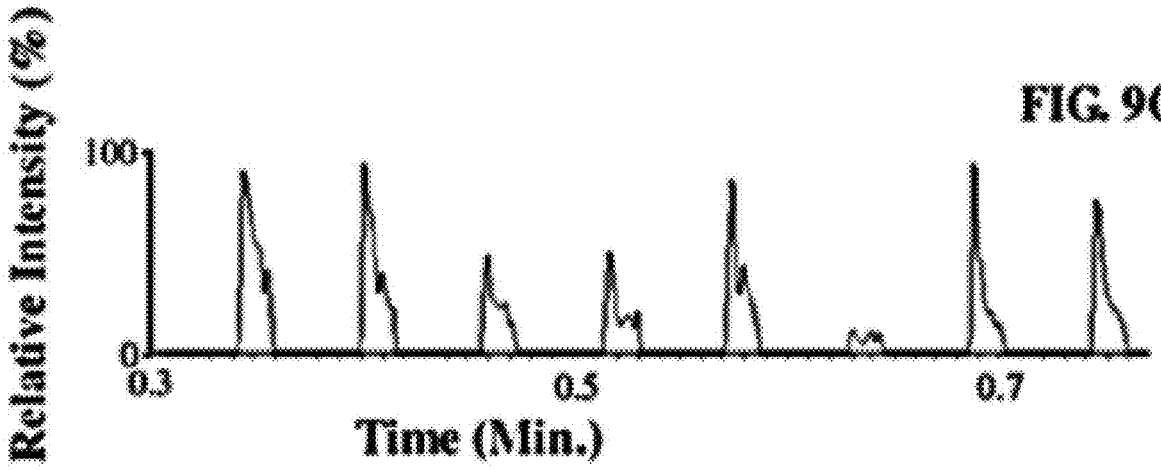
FIG. 9C is a positive DART API PE (with a 2.5 mm exit cap) mass chromatogram for codeine (SIM 300.3±0.5 Da) present in a 200 nL volume of a mixture of cocaine (0.01 mg/mL), fentanyl (0.01 mg/mL), and codeine (0.01 mg/mL), and methamphetamine applied to a mesh (eight (8) replicates, in positions 3-10) where the PE is performed for all 12 sample locations, according to an embodiment of the invention.
Figure 9D:
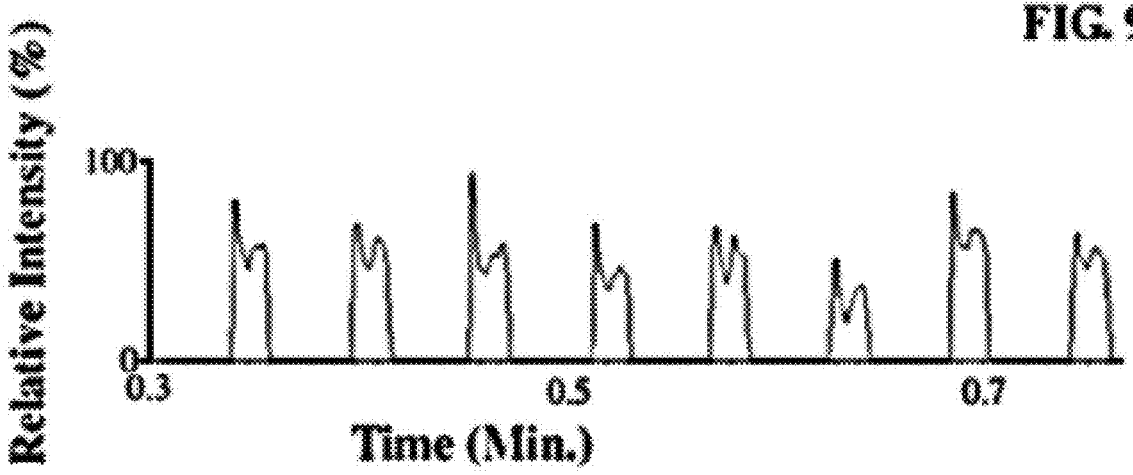
FIG. 9D is a positive DART API PE (with a 2.5 mm exit cap) TIC trace of 200 nL volume of a mixture of cocaine (0.01 mg/mL), fentanyl (0.01 mg/mL), and codeine (0.01 mg/mL), applied to a mesh (eight (8) replicates, in positions 3-10) where the PE is performed for all 12 sample locations, according to an embodiment of the invention.

FIG. 9A is a DART API PE (2.5 mm exit cap) mass chromatogram for fentanyl (SIM 337.2±0.5 Da). FIG. 9B is a positive DART API PE (2.5 mm exit cap) mass chromatogram for cocaine (SIM 304.3±0.5 Da). FIG. 9C is a positive DART API PE (2.5 mm exit cap) mass chromatogram for codeine (SIM 300.3±0.5 Da). FIG. 9D is a positive DART API PE (2.5 mm exit cap) TIC trace for the ions formed. A comparison of the TIC acquired using the 1.0 mm exit cap (FIG. 8D) with the TIC acquired using the 2.5 mm exit cap (FIG. 9D) demonstrates that while the area of ionization is increased with the 2.5 mm exit cap (compared with the 1.0 mm exit cap) the production of background species did not increase in the DART API PE (2.5 mm exit cap) compared with DART API PE (1.0 mm exit cap). In an embodiment of the invention the absence of ions prior to increasing the pressure to force the ionizing species to flow at the mesh has resulted in preferential production of sample related ions. The movement of sample into position followed by the introduction of carrier gas for a brief time as its pressure is increased has resulted preferential production of sample related ions. The peak width from the DART API PE (2.5 mm exit cap) mass chromatograms (FIGS. 9A, 9B, 9C) are narrow and comparable to those observed in the DART API PE (1.0 mm exit cap) (FIGS. 8A, 8B, 8C). The decrease in peak tailing is notable and an improvement in peak abundance is noted unlike the observations from the continuous and pulse with sample movement experiments where the 2.5 mm exit cap was observed to result in more continuous production of background species.

In an embodiment of the present invention, the narrow and abundant peaks observed in the mass chromatograms (FIGS. 9A, 9B, 9C) facilitate peak analysis since no peak detection is required. In the narrow and abundant peaks observed in the mass chromatograms (FIGS. 9A, 9B, 9C) no background subtraction is required to generate a digital representation of the information contained in the mass chromatograms. In the mass chromatograms (FIGS. 9A, 9B, 9C) it is possible to sum the ion current abundance versus time and generate an average value without regard for peak height. In this manner it is possible to generate a digital representation of the information contained in the mass chromatograms (FIGS. 9A, 9B, 9C). In this manner it is possible to analyze 384 samples DART API PE (2.5 mm exit cap) using two (2) seconds pulsed ionization ($t_1$), and one (1) second jump and delay ($t_2$), thereby requiring 3.4 seconds per sample for baseline resolved peaks and 22 minutes in total for the 384 samples. The information contained in the 384 mass chromatograms can be stored in a single file and accessed using parsing software. In an embodiment of the present invention, using parsing software both quantitative and qualitative information for 384 samples stored in the single file can be determined. In an embodiment of the present invention, by generating mass chromatograms containing peaks that do not require manipulation such as peak detection or background subtraction and combining the analysis with storage in a single file, the speed of opening the storage file and storing the information is not a constraint on the sampling speed.

In an embodiment of the present invention, where the sample comprises two or more sample spots and a first sample spot is separated from a second sample spot by a distance d, and the two or more sample spots are manipulated such that the one or more ionizing species are directed at the first sample spot during the time $t_1$ of a first pulse of the two or more pulses and the one or more ionizing species are directed at the second sample spot during the time $t_1$ of a second pulse of the two or more pulses, where the two or more pulses are separated by a time $t_2$, the peak abundance corresponding to the one or more sample ions detected by a spectrometer for the first sample spot are detected between a lower limit of approximately $0.9t_1$ seconds and an upper limit of approximately $1.1t_1$ seconds, where with regard to peak abundance approximately means plus or minus ten percent. In an alternative embodiment of the present invention, the peak abundance corresponding to the one or more sample ions detected by a spectrometer for the first sample spot are detected between a lower limit of approximately $0.95t_1$ seconds and an upper limit of approximately $1.05t_1$ seconds. In an embodiment of the present invention, the relative peak abundance corresponding to background ions compared to the peak abundance corresponding to the sample ions detected by the spectrometer for a sample spot is between a lower limit of approximately 0.01 and an upper limit of approximately 0.1.

Example 7

Pulsing of gas is completed by reducing the gas pressure on the proximal side of the exit cap FIG. 2A (119) and then increasing it in order to establish the flow of gas onto the mesh. The greater the flow of carrier gas the greater the transfer of ionizing species towards the mesh. In order to examine the effect of carrier gas flow (e.g., carrier gas volume) on the production of ions of interest from the sample, the same volume sample was exposed to ionizing species exiting a 1.0 mm exit cap versus a 2.5 mm exit cap where the volume of gas flowing through the exit orifice is greater for the 2.5 mm exit cap when the pressure on the proximal side of the hole is equal. Using a comparison of the SIM for an analyte fentanyl in the 200 nL sample a comparison of the relative abundance of the protonated molecule when gas exiting the 1.0 mm exit cap (FIG. 4A) versus the 2.5 mm exit cap (FIG. 5A) is dramatic in that the relative abundance is dramatically reduced when more ionizing species is directed at the sample on the mesh. Similar results are observed for cocaine (FIG. 4B) versus (FIG. 5B), and codeine (FIG. 4C) versus (FIG. 5C). Inspection of the relative abundance of all ions produced in each analysis, the TIC produced using the 1.00 exit cap (FIG. 4D) versus the 2.5 mm exit cap (FIG. 5D) indicates that while the relative abundance of the 1.0 mm exit cap appears to be significant with respect to the 2.5 mm exit cap the near continuous production and detection of ions when using the 2.5 mm exit cap is generating a significantly larger volume of ions that are reducing the production of analyte ions. The observation is made that the continuum of ions being produced in the 2.5 mm exit cap experiment is indicative of background species being produced and that those ions are reducing the volume of ionizing species available for the production of detectable analyte.

The experiments described in Examples 5-7 illustrate the impact of background species on detection without pulsed ionization and sample movement. An examination of the effect of the exit caps on the production of ions in the DART API HE is made by inspection of the SIM for an analyte fentanyl in the 200 nL sample. A comparison of the relative abundance of the protonated molecule with the 1.0 mm exit cap (FIG. 6A) versus the 2.5 mm exit cap (FIG. 7A) indicates that the effect of the exit cap is not as significant as the difference between DART API HE and DART API CIE (in that the relative abundance of fentanyl related ions is greater in the DART API CIE (see FIG. 5A) with the 1.0 mm exit cap. Similar results are observed cocaine (FIG. 6B) versus (FIG. 7B), and codeine (FIG. 6C) versus (FIG. 7C). Inspection of the relative abundance of all ions produced in each analysis, the TIC produced using the 1.0 mm exit cap (FIG. 6D) versus the 2.5 mm exit cap (FIG. 7D) is more comparable in the case of the DART API PE as the relative abundance of ions is more comparable despite the greater gas flow onto the mesh. In the case of the DART API HE there appears an improvement in the production of ions from analyte however the 2.5 mm exit cap still appears to induce ionization of background substances and thus is not ideal.

The experiments described in Examples 5-7 identified the impact of background on detection with DART API HE. In the DART API PE experimental conditions there is small period of time where the mass spectra generated are rich in sample related ions and then the sample related ions diminish as the spot where the sample has been applied to the mesh is no longer in the region being impinged by the ionizing species. In an embodiment of the invention an examination of the effect of exit caps on production of ions in the DART API PE is made by inspection of the SIM for an analyte fentanyl in the 200 nL sample. A comparison of the relative abundance of the protonated molecule when gas exiting the 1.0 mm exit cap (FIG. 8A) versus the 2.5 mm exit cap (FIG. 9A) is significantly improved for the 2.5 mm exit cap in that the relative abundance and the dramatic rise and fall of the fentanyl SIM is improved relative to the 1.0 mm exit cap. Similar results are observed cocaine (FIG. 8B) versus (FIG. 9B), and codeine (FIG. 8C) versus (FIG. 9C). Inspection of the relative abundance of all ions produced in each analysis indicates that in DART API PE the 2.5 mm exit cap improves detection of the analyte. The TIC produced using the 1.0 mm exit cap (FIG. 8D) indicates a production of a smaller abundance of ions than that produced with the 2.5 mm exit cap (FIG. 9D), however, as it is most desirable to produce ions of the analyte and not the background species, the DART API PE with the 2.5 mm exit cap is preferable.

In an embodiment of the invention DART API PE is observed to produce a more uniform peak indicating less interference from the background species. In an embodiment of the invention DART API PE and DART API HE reduces the potential that the sample will be completely removed from the target during the analysis restricting the potential for ionization of background species. In an embodiment of the invention a flow of gas that is sufficient to both desorb and ionize the sample is achieved by matching the pressure and flow of the device with the duration of the pulse to optimally desorb the sample over that duration of time and no longer. The observation of improved signal with different exit caps is significant in that as sample size might change it might be necessary to ionize from a larger surface area. Flowing more ionizing species through the 2.5 mm exit cap results in a wider field of ionization as shown in the DART API CIE (see FIG. 4 and FIG. 5) and the DART API HE where the TIC did not return to baseline. A wider field of ionization can yield an improved result if either the sample is applied with less positional precision or the sample was distributed over a larger area. However, with accurate positioning precision and low volume of sample applied the wider field of ionization is not necessary. On the other hand, an insufficient flow of carrier gas is also a condition to be presumably avoided. That is, sufficient ionizing species to successfully ionize the sample is required.

A common premise in analyzing a sample is that the more sample present the greater the signal intensity that is observed for that sample. Further it follows from that premise that the amount of sample ions desorbed can be increased by moving the sample through the ionizing species as a function of time in order that all of the sample might be desorbed. In unexpected results, the foundation for both these premises can be questioned based on the results presented. In an unexpected result, by (i) accurately positioning a sample with a reduced volume and (ii) accurately positioning a short pulse of ionizing species over the sample without moving the position of the of ionizing species relative to the sample increased sensitivity can be observed. Embodiments contemplated herein further include Embodiments R1-R35, S1 and T1-T50 following.

Embodiment R1. A sampler for depositing a volume of biological sample for atmospheric ionization including: a mesh designed to restrict the area of sample; a supply capable of directing ionizing species formed at atmosphere at the restricted area sample; and a spectrometer for analyzing sample ions formed by the ionizing species.

Embodiment R2. The sampler of Embodiment R1, where the sample is one or more of adsorbed, absorbed, bound and contained on the mesh.

Embodiment R3. The sampler of Embodiment R1 or R2, further including means for positioning the mesh to interact with the ionizing species.

Embodiment R4. The sampler of Embodiments R1 to R3, where the diluted sample density on the surface is between: a lower limit of approximately 1 pico gram per square millimeter; and an upper limit of approximately 1 nano gram per square millimeter.

Embodiment R5. The sampler of Embodiments R1 to R4, where the ionizing species include ionizing species dispersed in a gas.

Embodiment R6. The sampler of Embodiments R1 to R5, further comprising a gas ion separator introduced after the ionizing species interact with the diluted sample and before the sample ions enter the spectrometer.

Embodiment R7. The sampler of Embodiments R1 to R6, where the mesh is a grid.

Embodiment R8. The sampler of Embodiments R1 to R7, further including a means for moving the mesh relative to the ionizing species.

Embodiment R9. An ionizer for pulsed atmospheric ionization of a sample present in serum including a surface designed to restrict surface area; a robot programmed to receive a sample, programmed to generate a restricted area sample, and programmed to deliver the sample to the restricted area surface, where the sample density on the surface is less than approximately 1 nano gram per square millimeter; and a supply capable of directing ionizing species formed from a pulsed atmospheric ionizing source at the restricted area sample on the surface.

Embodiment R10. The ionizer of Embodiment R9, where the diluted sample is one or more of adsorbed, absorbed, bound and contained on the surface.

Embodiment R11. The ionizer of Embodiments R9 or R10, further including means for positioning the surface to interact with the ionizing species.

Embodiment R12. The ionizer of Embodiments R9 to R11, where the ionizing species include ionizing species dispersed in a gas.

Embodiment R13. The ionizer of Embodiments R9 to R12, further including a gas ion separator.

Embodiment R14. The ionizer of Embodiments R9 to R13, where the surface is a grid.

Embodiment R15. The ionizer of Embodiments R9 to R14, further including a means for moving the surface relative to the ionizing species.

Embodiment R16. The ionizer of Embodiments R9 to R15, where the surface supports multiple samples, the multiple samples separated by a distance sufficient that the ionizing species does not simultaneously desorb sample material from an adjacent sample.

Embodiment R17. The ionizer of Embodiments R9 to R16, where the surface is mounted on a movable stage, the stage speed is controlled to move the sample through the ionizing species at a speed such that the ionizing species does not simultaneously desorb sample material from an adjacent sample.

Embodiment R18. The ionizer of Embodiments R9 to R17, where the speed of the surface is sufficient that the sample is completely vaporized independent of adjacent samples.

Embodiment R19. The ionizer of Embodiments R9 to R18, where the speed of the surface is sufficient that the sample density on the surface per square millimeter can be increased.

Embodiment R20. A method of ionizing a sample including: receiving a sample; diluting the sample with water; applying the diluted sample to a grid; and passing the sample on the grid in front of a pulsed atmospheric pressure ionization source.

Embodiment R21. The method of Embodiment R20, where the sample is passed in front of the atmospheric ionization source at a regulated speed.

Embodiment R22. The method of Embodiments R20 or R21, where the regulated speed is increased to reduce matrix effects.

Embodiment R23. The method of Embodiments R20 to R22, where the flow of ionizing species exiting the pulsed atmospheric pressure ionization source is discontinuous.

Embodiment R24. The method of Embodiments R20 to R23, where the flow of ionizing species exiting the pulsed atmospheric pressure ionization source is started when a sample moved into positioned in front of the ionizing source exit in order to complete the analysis of that sample Embodiment R25. The method of Embodiments R20 to R24, where the flow of ionizing species exiting the pulsed atmospheric pressure ionization source and entry of the sample into a position proximal to the flow is coincidental in time.

Embodiment R26. The method of Embodiment R25, where the coincidental time period is limited in time to incomplete desorption of the sample.

Embodiment R27. The method of Embodiment R26, where incomplete desorption results in generation of a more Gaussian distribution of ionized sample.

Embodiment R28. The method of Embodiment R27, where the Gaussian distribution of sample related ions enables collection of a more uniform packet of data.

Embodiment R29. The method of Embodiment R28, where the uniform packet of data can be processed using statistical analysis program without requirement for background subtraction of data that would normally be collected when the sample present on the grid was completely desorbed Embodiment R30. The method of Embodiment R29, where the results of statistical analysis are improved by using the more uniform packets of data.

Embodiment R31. The method of Embodiment R30, where the flow of ionizing species exiting the pulsed atmospheric pressure ionization source is discontinuous enabling a reduction in the volume of gas required for analysis Embodiment R32. The method of Embodiment R31, where the volume of carrier gas, required for the desorption and ionization of a sample in the DART experiment is reduced by greater than 95 percent.

Embodiment R33. The method of Embodiment R32, where the use of carrier gas pulsing eliminates the production of ions unrelated to the sample presented on the grid.

Embodiment R34. The method of Embodiment R33, where the use of carrier gas pulsing to generate the ionizing species can be combined with the pulsing of a second gas carrier gas to permit selective ionization of different substances present in the sample by reaction of the ionized sample with the second gas commonly referred to as a dopant.

Embodiment R35. An atmospheric ionization device including: a mesh adapted to contact a sample; a carrier gas supply adapted to generate a pulsed carrier gas; a first atmospheric pressure chamber having an inlet for the pulsed carrier gas, a first electrode therein, and a counter-electrode for creating an electrical discharge in the pulsed carrier gas creating at least metastable neutral excited-state species; an outlet port for directing ionizing species formed at atmosphere directed at the mesh; and a spectrometer for analyzing sample ions formed by the ionizing species interacting with the sample on the mesh.

Embodiment S1. A pulsatile flow atmospheric pressure ionization device for ionizing a sample including: a first atmospheric pressure chamber including: an inlet for a carrier gas; a first electrode; a counter-electrode; and an outlet port; a power supply configured to energize the first electrode and the counter-electrode to provide a current between the first and counter-electrodes to generate a discharge; and a pressure regulator configured to introduce two or more pulses of the carrier gas to the first atmospheric pressure chamber, where the two or more pulses are separated by a time t, where the power supply operates continuously during time t, where when each of the two or more pulses of the carrier gas interact with the discharge one or more ionizing species are generated, where the gaseous contact between the one or more ionizing species and the pulsatile carrier gas directs the one or more ionizing species formed at atmosphere through the outlet port at a sample, thereby forming ions of the sample.

Embodiment T1. A pulsatile flow atmospheric pressure ionization device for ionizing a sample including: a first atmospheric pressure chamber including: an inlet for a carrier gas; a first electrode; a counter-electrode; and an outlet port; a power supply configured to energize the first electrode and the counter-electrode to provide a current between the first and counter-electrodes to generate a discharge; and a pressure regulator configured to introduce two or more pulses of the carrier gas to the first atmospheric pressure chamber, where a duration of two or more pulses of carrier gas is for a time $t_1$, where the two or more pulses of carrier gas are separated by a time $t_2$, where interaction of the two or more pulses of carrier gas with the discharge during time $t_1$ generates one or more ionizing species, where a gaseous contact between the one or more ionizing species and the two or more pulses of carrier gas directs the one or more ionizing species formed at atmosphere through the outlet port at a sample, thereby forming ions of the sample.

Embodiment T2. The sampler of Embodiments T1, where the power supply is configured to continuously energize the first electrode and the counter-electrode.

Embodiment T3. The sampler of Embodiments T1 or T2, where the one or more ionizing species comprise ions, electrons, hot atoms, hot molecules, radicals and metastable neutral excited state species.

Embodiment T4. The sampler of Embodiments T1 to T3, where the sample comprises an analyte applied to a mesh, a dip-it probe, a SPME fiber, a wand with a ticket, a glass or metal slide, a filament, glass or metal rod, a fiber, or a wire loop.

Embodiment T5. The sampler of Embodiments T1 to T4, further comprising a cap at the outlet port, where the cap has an exit hole between: a lower limit of approximately 0.1 mm; and an upper limit of approximately 4 mm.

Embodiment T6. The sampler of Embodiments T1 to T5, where the sample comprises two or more sample spots, where first sample spot is separated from a second sample spot by a distance d, where the two or more sample spots are manipulated such that the one or more ionizing species are directed at the first sample spot during the time $t_1$ of a first pulse of the two or more pulses of carrier gas and the one or more ionizing species are directed at the second sample spot during the time $t_1$ of a second pulse of the two or more pulses of carrier gas.

Embodiment T7. The sampler of Embodiment T6, where the two or more sample spots are manipulated such that the two or more sample spots remain stationary during the time $t_1$.

Embodiment T8. The sampler of Embodiments T6 or T7, where the two or more sample spots are manipulated during the time $t_2$ such that the one or more ionizing species are directed from the first sample spot to the second sample spot.

Embodiment T9. The sampler of Embodiments T6 to T8, where the two or more sample spots are manipulated such that the two or more sample spots are moved through the distance d during the time $t_2$.

Embodiment T10. The sampler of Embodiment T9, where the distance d is between:

a lower limit of approximately 0.5 mm and an upper limit of approximately 9 mm.

Embodiment T11. The sampler of Embodiments T1 to T6, further comprising a cap at the outlet port with an exit hole, where an exit hole dimension is selected to result in a spatial resolution between: a lower limit of approximately 0.2 mm; and an upper limit of approximately 9 mm.

Embodiment T12. The sampler of Embodiment T11, where the sample comprises two or more sample spots, where first sample spot is separated from a second sample spot by a distance d, where the spatial resolution is selected based on the distance d.

Embodiment T13. The sampler of Embodiments T1 to T12, where the discharge produced is one or more of a corona discharge, an arc discharge and a glow discharge.

Embodiment T14. The sampler of Embodiments T1 to T13, where the time $t_1$ is between: a lower limit of approximately 0.1 seconds and an upper limit of approximately 10 seconds.

Embodiment T15. The sampler of Embodiments T1 to T14, where the time $t_2$ is between: a lower limit of approximately 0.1 seconds and an upper limit of approximately 10 seconds.

Embodiment T16. The sampler of Embodiments T1 to T15, further comprising a heating element in fluid communication with the first atmospheric pressure chamber.

Embodiment T17. The sampler of Embodiment T16, where the carrier gas is passed in proximity to the heating element.

Embodiment T18. The sampler of Embodiment T16 or T17, where the carrier gas was heated to a temperature between a lower limit of approximately 100° C. and an upper limit of approximately 500° C.

Embodiment T19. The sampler of Embodiments T1 to T18, further comprising a grid located at the outlet port.

Embodiment T20. The sampler of Embodiment T19, where a first potential is applied to the grid to deflect charged species.

Embodiment T21. The sampler of Embodiments T1 to T20, where carrier gas pressure is between a lower limit of approximately 0 psi and an upper limit of approximately 80 psi.

Embodiment T22. A device for analyzing a sample including a first atmospheric pressure chamber including an inlet for a carrier gas, a first electrode, a counter-electrode, and an outlet port; a power supply configured to energize the first and the counter-electrode to provide a current between the first and counter-electrodes to generate a discharge; a pressure regulator configured to introduce a carrier gas to the first atmospheric pressure chamber to generate two or more pulses of carrier gas, where a duration of two or more pulses of carrier gas is for a time $t_1$, where the two or more pulses of carrier gas are separated by a time $t_2$, where interaction of the two or more pulses of carrier gas with the discharge during time $t_1$ generates one or more ionizing species, where a gaseous contact between the one or more ionizing species and the two or more pulses of carrier gas directs the one or more ionizing species formed at atmosphere through the outlet port at a sample, thereby generating one or more sample ions and a spectrometer for analyzing the one or more sample ions.

Embodiment T23. The device of Embodiment T22, where the power supply is configured to continuously energize the first and the counter-electrode.

Embodiment T24. The device of Embodiment T22 or T23, where the one or more ionizing species comprise ions, electrons, hot atoms, hot molecules, radicals and metastable neutral excited state species.

Embodiment T25. The device of Embodiments T22 to T24, where the sample comprises an analyte applied to a mesh, a dip-it probe, a SPME fiber, a wand with a ticket, a glass or metal slide, a filament, glass or metal rod, a fiber, or a wire loop.

Embodiment T26. The device of Embodiments T22 to T25, further comprising a gas ion separator.

Embodiment T27. The device of Embodiments T22 to T26, where the gas ion separator increases a peak abundance of one or more sample ions relative to low mass ions.

Embodiment T28. A device for analyzing a sample including a first atmospheric pressure chamber including an inlet for a carrier gas, a first electrode, a counter-electrode, and an outlet port; a power supply configured to energize the first and the counter-electrode to provide a current between the first and counter-electrodes to generate a discharge; a pressure regulator configured to introduce a carrier gas to the first atmospheric pressure chamber to generate two or more pulses of carrier gas, where a duration of two or more pulses of carrier gas is for a time $t_1$, where the two or more pulses of carrier gas are separated by a time $t_2$, where interaction of the two or more pulses of carrier gas with the discharge during time $t_1$ generates one or more ionizing species, where a gaseous contact between the one or more ionizing species and the two or more pulses of carrier gas directs the one or more ionizing species formed at atmosphere through the outlet port at a sample, thereby generating one or more sample ions and a spectrometer for generating a mass chromatogram from the analysis of the one or more sample ions.

Embodiment T29. The device of Embodiment T28, where the power supply is configured to continuously energize the first and the counter-electrode.

Embodiment T30. The device of Embodiment T28 or T29, where the one or more ionizing species comprise ions, electrons, hot atoms, hot molecules, radicals and metastable neutral excited state species.

Embodiment T31. The device of Embodiments T28 to T30, where the sample comprises an analyte applied to a mesh, a dip-it probe, a SPME fiber, a wand with a ticket, a glass or metal slide, a filament, glass or metal rod, a fiber, or a wire loop.

Embodiment T32. The device of Embodiments T28 to T31, where the sample comprises two or more sample spots, where first sample spot is separated from a second sample spot by a distance d, where the two or more sample spots are manipulated such that the one or more ionizing species are directed at the first sample spot during the time $t_1$ of a first pulse of the two or more pulses of carrier gas and the one or more ionizing species are directed at the second sample spot during the time $t_1$ of a second pulse of the two or more pulses of carrier gas.

Embodiment T33. The device of Embodiments T28 to T32, where the two or more sample spots are manipulated such that the two or more sample spots remain stationary during the time $t_1$.

Embodiment T34. The device of Embodiments T28 to T33, where the two or more sample spots are manipulated during the time $t_2$ such that the one or more ionizing species are directed from the first sample spot to the second sample spot.

Embodiment T35. The device of Embodiments T28 to T34, further comprising a gas ion separator.

Embodiment T36. The device of Embodiment T35, where the gas ion separator increases a peak abundance of one or more sample ions relative to low mass ions.

Embodiment T37. The device of Embodiments T28 to T36, where no background ions are detected during time $t_2$.

Embodiment T38. The device of Embodiments T28 to T37, where a relative peak abundance corresponding to background ions compared to a peak abundance corresponding to the one or more sample ions detected by the spectrometer for the first sample spot is between: a lower limit of approximately 0.01 and an upper limit of approximately 0.1.

Embodiment T39. The device of Embodiments T28 to T38, where the one or more sample ions detected by the spectrometer are detected during time $t_1$.

Embodiment T40. The device of Embodiments T28 to T39, where the one or more sample ions detected by the spectrometer corresponding to the first sample spot are detected during time $t_1$.

Embodiment T41. The device of Embodiments T28 to T40, where a peak abundance corresponding to the one or more sample ions detected by the spectrometer for the first sample spot are detected between a lower limit of approximately $0.9 \times t_1$ seconds and an upper limit of approximately $1.1 \times t_1$ seconds.

Embodiment T42. The device of Embodiments T28 to T41, where one or more peaks in the mass chromatogram do not require peak detection.

Embodiment T43. The device of Embodiments T28 to T42, where peak abundance during time $t_1$ eliminates the need for peak detection.

Embodiment T44. The device of Embodiments T28 to T43, where the mass chromatogram for a plurality of samples is stored in one (1) data file.

Embodiment T45. A method for ionizing an analyte with a pulsed flow atmospheric pressure ionization device including (a) energizing a first electrode relative to a second electrode spaced apart from the first electrode, where the first electrode and the second electrode are located in a chamber, where the chamber comprises a gas inlet and an exit, where energizing the first electrode relative to the second electrode generates a discharge, (b) introducing two or more pulses of carrier gas through a gas inlet into the chamber, where a duration of the two or more pulses of carrier gas is for a time $t_1$, where the two or more pulses of carrier gas are separated by a time $t_2$, (c) generating ions, electrons, and excited state species of the two or more pulses of carrier gas, and (d) directing the ions, electrons, excited state species at an analyte.

Embodiment T46. The method of Embodiment T45, where the second electrode is continuously energized relative to the first electrode during a time $t_1+t_2$.

Embodiment T47. The method of Embodiment T45 or T46, where the analyte comprises a first sample spot and a second sample spot, where first sample spot is separated from the second sample spot by a distance d, further including (e) manipulating the first sample spot and the second sample spot such that the ions, electrons, excited state species are directed at the first sample spot during a first pulse of the two or more pulses of carrier gas and the ions, electrons, excited state species are directed at the second sample spot during a second pulse of the two or more pulses of carrier gas.

Embodiment T48. The method of Embodiment T47, further including (f) holding the first sample spot stationary during a first time of duration $t_1$.

Embodiment T49. The method of Embodiment T48, further including (g) holding the second sample spot stationary during a second time of duration $t_1$.

Embodiment T50. The method of Embodiment T49, further including (h) moving from the first sample spot to the second sample spot during time $t_2$.

Example embodiments of the methods, systems, and components of the present invention have been described herein. As noted elsewhere, these example embodiments have been described for illustrative purposes only, and are not limiting. Other embodiments are possible and are covered by the invention. Such embodiments will be apparent to persons skilled in the relevant art(s) based on the teachings contained herein. For example, it is envisaged that, irrespective of the actual shape depicted in the various Figures and embodiments described above, the outer diameter exit of the inlet tube can be tapered or non-tapered and the outer diameter entrance of the outlet tube can be tapered or non-tapered.

Thus, the breadth and scope of the present invention should not be limited by any of the above-described exemplary embodiments, but should be defined only in accordance with the following claims and their equivalents.

We claim:

1. An ionizer for pulsed atmospheric ionization of a sample comprising:

an atmospheric pressure chamber comprising:

a first inlet for a first carrier gas;

a first electrode;

a counter-electrode; and an outlet port;

a power supply configured to energize the first electrode and the counter-electrode to provide a current between the first and counter-electrodes to generate a discharge; and a first pulse generator configured to pulse the first carrier gas into the first atmospheric pressure chamber starting at time $t_1$ and ending at time $t_2$; and a second pulse generator configured to pulse the second carrier gas into the atmospheric pressure chamber starting at time $t_2$ and ending at time $t_1$ for a subsequent pulsing of the first carrier gas.

2. A method of ionizing an analyte with a pulsed flow atmospheric pressure ionization device of claim 1, comprising:

(a) energizing a first electrode relative to a second electrode spaced apart from the first electrode, where the first electrode and the second electrode are located in a chamber, where the chamber comprises a first gas inlet and a first exit, and a second gas inlet and a second exit, where energizing the first electrode relative to the second electrode generates a discharge;

(b) introducing a first pulse of a first carrier gas through the first gas inlet into the chamber, where a duration of the first pulse of carrier gas is for a time beginning at $t_1$, and ending at time $t_2$, (c) introducing a pulse of a second carrier gas through the second gas inlet into the chamber, where a duration beginning at $t_2$, and ending at $t_1$ of a subsequent pulsing of the first carrier gas;

(d) generating ions, electrons, and excited state species by the pulses of the first carrier gas; and (e) directing the ions, electrons, excited state species at the analyte.

3. A method of ionizing an analyte with a pulsed flow atmospheric pressure ionization device of claim 1, comprising:

(a) energizing a first electrode relative to a second electrode spaced apart from the first electrode, where the first electrode and the second electrode are located in a chamber, where the chamber comprises a first gas inlet and a first exit, and a second gas inlet and a second exit, where energizing the first electrode relative to the second electrode generates a discharge;

(b) introducing a first pulse of a first carrier gas through the first gas inlet into the chamber, where a duration of the first pulse of carrier gas is for a time beginning at $t_1$, and ending at time $t_2$, (c) introducing a continuous flow of a second carrier gas through the second gas inlet into the chamber;

(d) generating ions, electrons, and excited state species by the first and second carrier gases; and (e) directing the ions, electrons, excited state species at the analyte.

4. A method of ionizing an analyte with a pulsed flow atmospheric pressure ionization device of claim 1, comprising:

(a) energizing a first electrode relative to a second electrode spaced apart from the first electrode, where the first electrode and the second electrode are located in a chamber, where the chamber comprises a first gas inlet and a first exit, and a second gas inlet and a second exit, where energizing the first electrode relative to the second electrode generates a discharge;

(b) introducing a first pulse of a first carrier gas through the first gas inlet into the chamber, where a duration of the first pulse of carrier gas is for a time beginning at $t_1$ and ending at time $t_2$;

(c) introducing a pulse of a second carrier gas through the second gas inlet into the chamber, where a duration beginning at $t_2$, and ending at $t_1$ of a subsequent pulse of the first carrier gas;

(d) generating ions, electrons, and excited state species by the pulses of the first and second carrier gases; and (e) directing the ions, electrons, excited state species at the analyte.

* * * * *